US010190264B2

(12) United States Patent
Hamilton et al.

(10) Patent No.: US 10,190,264 B2
(45) Date of Patent: Jan. 29, 2019

(54) MULTI-FUNCTIONAL RAILWAY FASTENING COMPONENT ADJUSTMENT SYSTEM

(71) Applicant: MOW Equipment Solutions, Inc., Linwood, KS (US)

(72) Inventors: William Michael Hamilton, Linwood, KS (US); Justin Wynne Tomac, Bonner Springs, KS (US)

(73) Assignee: MOW Equipment Solutions, Inc., Linwood, KS (US)

( * ) Notice: Subject to any disclaimer, the term of this patent is extended or adjusted under 35 U.S.C. 154(b) by 311 days.

(21) Appl. No.: 15/090,428

(22) Filed: Apr. 4, 2016

(65) Prior Publication Data

US 2016/0289899 A1 Oct. 6, 2016

Related U.S. Application Data

(60) Provisional application No. 62/143,012, filed on Apr. 3, 2015.

(51) Int. Cl.
*E01B 29/32* (2006.01)

(52) U.S. Cl.
CPC ..... *E01B 29/32* (2013.01)

(58) Field of Classification Search
CPC ..... E01B 29/32; E01B 29/40
See application file for complete search history.

(56) References Cited

U.S. PATENT DOCUMENTS

| | | | | | |
|---|---|---|---|---|---|
| 4,457,060 | A | | 7/1984 | Parks et al. | |
| 4,890,558 | A | | 1/1990 | Quella et al. | |
| 4,903,611 | A | | 2/1990 | Holley | |
| 5,074,219 | A | | 12/1991 | Theurer et al. | |
| 5,117,760 | A | | 6/1992 | Almaraz et al. | |
| 5,277,122 | A | * | 1/1994 | Almaraz | E01B 29/32 104/17.2 |
| 5,331,899 | A | | 7/1994 | Holley | |
| 5,438,931 | A | * | 8/1995 | Becker | E01B 29/32 104/17.2 |
| 5,586,502 | A | * | 12/1996 | Weber | E01B 29/24 104/17.2 |
| 5,694,856 | A | * | 12/1997 | Theurer | E01B 29/32 104/17.2 |
| 5,730,060 | A | * | 3/1998 | Straub | E01B 29/32 104/17.2 |
| 5,915,744 | A | | 6/1999 | Cotsford | |

(Continued)

*Primary Examiner* — Jason C Smith
(74) *Attorney, Agent, or Firm* — Kilpatrick Townsend & Stockton LLP

(57) ABSTRACT

A multi-functional railway fastening component adjustment system is disclosed. The system may include a railway component adjuster. The railway component adjuster may include adjustment tools pivotally coupled with a tool bracket. The railway component adjuster may be configured to selectively engage railway fastening components from different addressing positions of the adjustment tools at least in part by pivoting to a selected addressing position. The railway component adjuster may be adapted to hold the one or more adjustment tools in the selected addressing position to make a component adjustment to the railway fastening component with the adjustment tools. The component adjustment may include movement of the railway fastening component with respect to a rail of a railway.

11 Claims, 19 Drawing Sheets

(56) References Cited

U.S. PATENT DOCUMENTS

| | | | | |
|---|---|---|---|---|
| 6,138,573 | A * | 10/2000 | Brenny | E01B 29/24 104/17.2 |
| 6,662,729 | B1 * | 12/2003 | Madison | E01B 29/32 104/17.2 |
| 7,104,200 | B2 | 9/2006 | Hosking et al. | |
| 7,574,961 | B2 * | 8/2009 | Barezzani | E01B 29/24 104/17.2 |
| 7,677,177 | B2 * | 3/2010 | Ganz | E01B 29/32 104/17.1 |
| 8,485,103 | B2 * | 7/2013 | Miller | E01B 29/26 104/17.2 |
| 8,522,688 | B2 | 9/2013 | Pritzl | |
| 2011/0072998 | A1 * | 3/2011 | Noll | E01B 29/32 104/16 |
| 2011/0308421 | A1 * | 12/2011 | Pritzl | E01B 29/32 104/17.2 |
| 2013/0276278 | A1 * | 10/2013 | Barezzani | E01B 29/32 29/243.56 |
| 2015/0053449 | A1 | 2/2015 | Henke | |
| 2016/0153151 | A1 * | 6/2016 | Irion | E01B 29/10 104/9 |
| 2016/0289899 | A1 * | 10/2016 | Hamilton | E01B 29/32 |

* cited by examiner

MULTI-FUNCTIONAL RAILWAY FASTENING COMPONENT ADJUSTMENT SYSTEM

CROSS-REFERENCE TO RELATED APPLICATIONS

The present application claims benefit under 35 USC 119(e) of U.S. Provisional Application No. 62/143,012, filed on Apr. 3, 2015, by Hamilton et al. and entitled "Compact Bolt-On Railway Anchor Spreading Apparatus," the entire disclosure of which is incorporated herein by reference for all purposes.

BACKGROUND

Certain embodiments of the present disclosure relate generally to railways, and in particular to maintenance of way with apparatuses and methods for railway fastening component adjustment.

With the hundreds of thousands of miles of railroad track traversing the United States alone, in addition to the great lengths throughout other countries of the world, maintenance of way is a tremendous and important effort. One aspect of maintenance of way is railway tie maintenance. Railway ties are typically made of wood or other materials that age and deteriorate over time due to railway use and environmental conditions. As a result, railway ties eventually require replacement with new railway ties.

There are multiple steps in a process of railway tie replacement. Rails of railroad tracks are typically fastened to railway ties with a combination of railway spikes, tie plates fastened to the railway ties with the railway spikes, and railway anchors attached to undersides of the rails to anchor the rails to sides of the railway ties. Under current work practices, a typical tie replacement gang comprises several unique machines, in some cases 20 and more, forming a long line and arranged in the necessary order to perform sequential tasks for removing an old, worn railway tie and replacing it with a new railway tie. The work window is often 8-12 hours long and typically includes 2,000-5,000 ties that are replaced per day. Several issues are presented by the process, including issues redounding in inefficiencies, costs, and risks for personal injury. The trend is toward shorter and shorter work windows, with a desire for more productivity. So, more productive equipment is needed. Also, at the end of an allotted time of a work window, due to the sheer number of machines in a work gang that must get off the main track onto the side track in order to allow normal rail traffic to pass, the process of moving all machines onto the side track can take several minutes.

Thus, there is a need to solve these problems and provide for apparatuses and methods for railway fastening component adjustment. These and other needs are addressed by the present disclosure.

BRIEF SUMMARY

Certain embodiments of the present disclosure relate generally to railways, and in particular to maintenance of way with apparatuses and methods for railway fastening component adjustment.

In one aspect, a multi-functional railway fastening component adjustment system is disclosed. The system may include any one or combination of the following. A railway component adjuster may include a tool bracket and one or more adjustment tools pivotally coupled with the tool bracket. The railway component adjuster may further include one or more tool actuators coupled with the one or more adjustment tools and the tool bracket, the one or more tool actuators adapted to cause pivotal movement of the one or more adjustment tools with respect to the tool bracket. The railway component adjuster may further include a main bracket comprising one or more attachment components to couple the railway component adjuster to a frame structure. The railway component adjuster may be configured to selectively engage each railway fastening component of a plurality of railway fastening components from a plurality of different addressing positions of the one or more adjustment tools at least in part by pivoting to a selected addressing position of the plurality of different addressing positions. The plurality of railway fastening components may include a railway anchor and a railway tie plate. The railway component adjuster may be adapted to hold the one or more adjustment tools in the selected addressing position to make a component adjustment to the railway fastening component with the one or more adjustment tools. The component adjustment may include movement of the railway fastening component with respect to a rail of a railway.

In another aspect, a method for a multi-functional railway fastening component adjustment system is disclosed. The method may include any one or combination of the following. A railway component adjuster may be formed. The railway component adjuster may include a tool bracket and one or more adjustment tools pivotally coupled with the tool bracket. The railway component adjuster may further include one or more tool actuators coupled with the one or more adjustment tools and the tool bracket, the one or more tool actuators adapted to cause pivotal movement of the one or more adjustment tools with respect to the tool bracket. The railway component adjuster may further include a main bracket comprising one or more attachment components to couple the railway component adjuster to a frame structure. The railway component adjuster may be configured to selectively engage each railway fastening component of a plurality of railway fastening components from a plurality of different addressing positions of the one or more adjustment tools at least in part by pivoting to a selected addressing position of the plurality of different addressing positions. The plurality of railway fastening components may include a railway anchor and a railway tie plate. The railway component adjuster may be adapted to hold the one or more adjustment tools in the selected addressing position to make a component adjustment to the railway fastening component with the one or more adjustment tools. The component adjustment may include movement of the railway fastening component with respect to a rail of a railway.

In yet another aspect, a method for a multi-functional railway fastening component adjustment system is disclosed. The method may include any one or combination of the following. Component adjustment of a railway fastening component with one or more adjustment tools of a railway component adjuster may be caused. The railway component adjuster may include a tool bracket and the one or more adjustment tools pivotally coupled with the tool bracket. The railway component adjuster may further include one or more tool actuators coupled with the one or more adjustment tools and the tool bracket, the one or more tool actuators adapted to cause pivotal movement of the one or more adjustment tools with respect to the tool bracket. The railway component adjuster may further include a main bracket comprising one or more attachment components to couple the railway component adjuster to a frame structure. The railway component adjuster may be configured to selectively engage each railway fastening component of a plurality of railway fastening components from a plurality of different addressing positions of the one or more adjustment tools at least in part by pivoting to a selected addressing position of the plurality of different addressing positions. The plurality of railway fastening components may include a railway anchor and a railway tie plate. The railway component adjuster may be adapted to hold the one or more adjustment tools in the selected addressing position to make a component adjustment to the railway fastening component with the one or more adjustment tools. The component adjustment may include movement of the railway fastening component with respect to a rail of a railway.

In some embodiments, the component adjustment may include removal of the railway fastening component from the railway. In some embodiments, the pivoting to the selected addressing position of the plurality of different addressing positions may include pivoting about one or more pivot points to simultaneously engage a base of the rail and with the railway fastening component one or more tool feet of the one or more adjustment tools. In some embodiments, the railway component adjuster may be configured to selectively engage each railway fastening component of the plurality of railway fastening components from the plurality of different addressing positions of the one or more adjustment tools based at least in part on a first set of one or more methods when a railway tie associated with the railway fastening component is present and a second set of one or more methods in an absence of the railway tie.

In some embodiments, the one or more adjustment tools may include a pair of adjustment tools in an opposing arrangement to engage the railway fastening component from a gage side of the rail and from a field side of the rail. In some embodiments, the pair of adjustment tools may include a field-side tool, where the field-side tool comprises a first tool foot, the first tool foot including a first ledge and first set of angled faces. The pair of adjustment tools may include a gage-side tool, where the field-side tool comprises a second tool foot, the second tool foot including a second ledge and second set of angled faces. In some embodiments, the first ledge and first set of angled faces of the first tool foot may be formed differently with respect to the second ledge and second set of angled faces of the second tool foot based at least in part on a tilt of the rail toward a gage side of the rail.

In some embodiments, the frame structure may be coupled to the railway component adjuster at least in part via a power cylinder and a slide component assembly. The frame structure may include one or more roller assemblies for rolling engagement with the rail. A rail clamp assembly may be coupled to a forward leg of the frame structure and adapted to clamp the rail to facilitate the component adjustment. In some embodiments, the rail clamp assembly may include an opposing pair of clamp tools adapted to evenly engage surfaces of a head portion of the rail. One clamp tool of the pair of clamp tools may include a first contour, and the other clamp tool of the pair of clamp tools may include a second contour that is different from the first contour. The first contour and the second contour may be based at least in part on a tilt of the rail toward a gage side of the rail. In some embodiments, the frame structure may be adapted to house a railway workhead. The railway workhead may perform one or more railway component functions that are different from a set of functions performed by the railway component adjuster.

In some embodiments, the railway component adjuster may include a spherical segment joint assembly interfacing with a portion of the tool bracket and coupling the tool bracket to the power cylinder. The spherical segment joint assembly may include a pair of spherical segment discs in a back-to-back arrangement. The tool bracket may include concave pockets corresponding to each spherical segment disc of the pair of spherical segment discs. An arrangement of the spherical segment joint assembly and the concave pockets may allow: a first spherical segment disc of the pair of spherical segment discs to move away from a first pocket of the concave pockets responsive to a power cylinder of the railway component adjuster moving the tool bracket in a first direction; and a second spherical segment disc of the pair of spherical segment discs to move away from a second pocket of the concave pockets responsive to the power cylinder moving the tool bracket in a second direction.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the following appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability, or configuration of the disclosure. Rather, the ensuing description of the preferred exemplary embodiment(s) will provide those skilled in the art with an enabling description for implementing a preferred exemplary embodiment of the disclosure. It should be understood that various changes may be made in the function and arrangement of elements without departing from the spirit and scope of the disclosure as set forth in the appended claims.

Various embodiments according to the present disclosure may provide for railway component adjustment when a railway tie is present, when a railway tie is absent, prior to railway tie removal, after railway tie removal, and/or as part of processes of railway tie removal and/or installation. Certain embodiments may provide for railway anchor adjustment, which may include adjusting railway anchors as part of a process of railway spike removal, adjusting railway anchors as part of a process of tie plate removal, adjusting railway anchors as part of a process of railway tie removal, removing railway anchors as part of a process of railway anchor removal, adjusting railway anchors as part of a process of anchoring rails, and/or the like. Certain embodiments may provide for railway tie plate adjustment, which may include adjusting tie plates as part of a process of tie plate removal, adjusting tie plates as part of a process of railway tie removal, removing tie plates as part of a process of tie plate replacement, adjusting tie plates as part of a process of tie plate installation, seating, and/or railway spike driving, and/or the like.

Various embodiments will now be discussed in greater detail with reference to the accompanying figures, beginning with FIG. 1.

Figure 1:
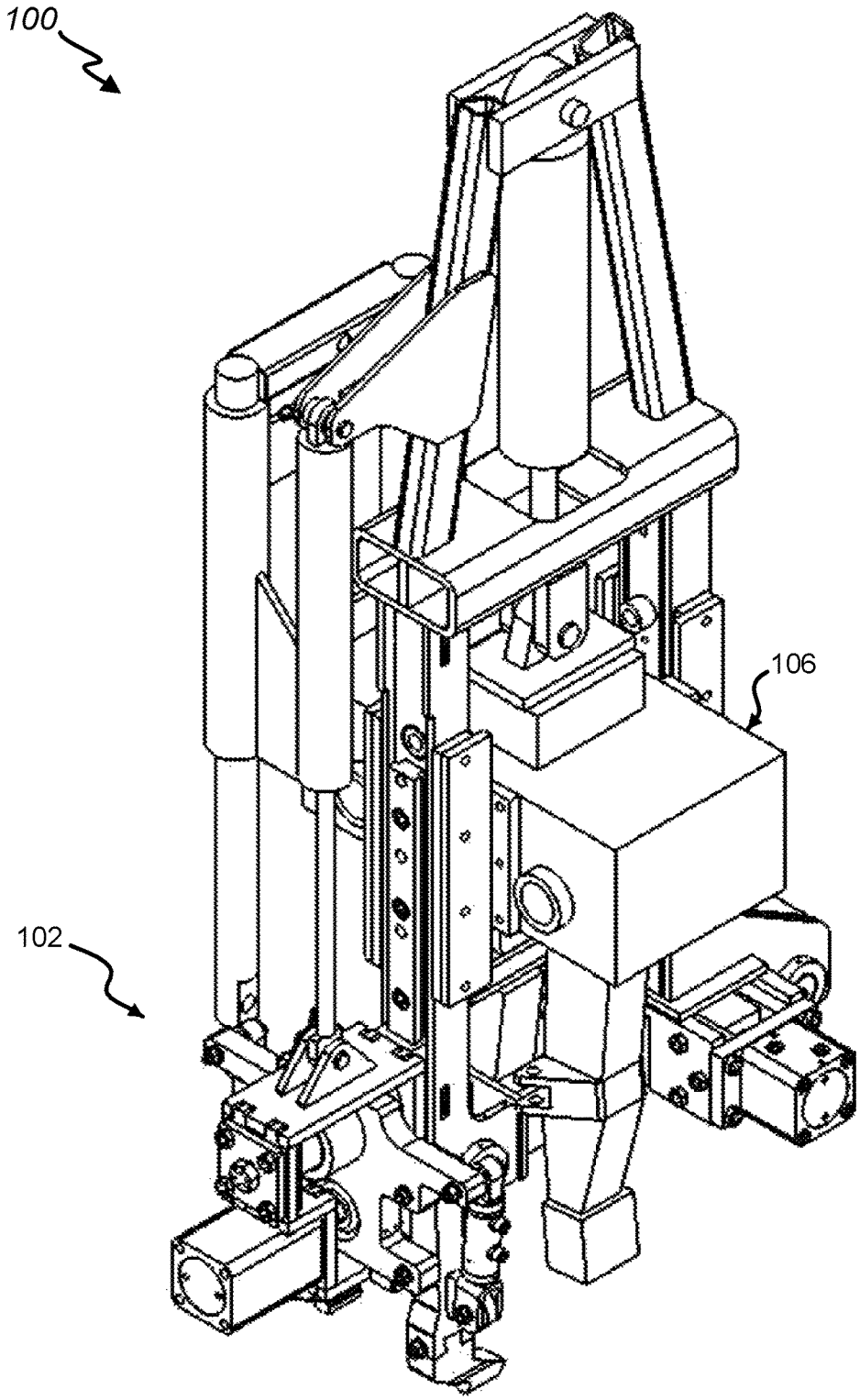
FIG. 1 depicts a perspective view of a multi-functional railway component adjustment system, in accordance with certain embodiments of the present disclosure.

FIG. 1 depicts a perspective view of a multi-functional railway component adjustment system 100, in accordance with certain embodiments of the present disclosure. In some embodiments, the component adjustment system 100 may include an anchor adjustment assembly 102 and a spike-pulling workhead 106. While certain embodiments of the component adjustment system 100 are illustrated with the spike-pulling workhead 106, the component adjustment system 100 may include other types of railway machinery and workheads in lieu of the spike-pulling workhead 106. Other embodiments, for example, may include spike-driving workheads, railway anchor installation workheads, and/or any other suitable type of railway installation and/or maintenance machinery.

Materials for various structural components of the component adjustment system 100 may be selected such that the structural components can generate necessary forces to move an railway components in accordance with various embodiments disclosed herein, while safely withstands stresses imparted to the structural elements of the system from those aforementioned forces. Said materials may include structural quality alloy steels with medium to high carbon content.

Figure 2:
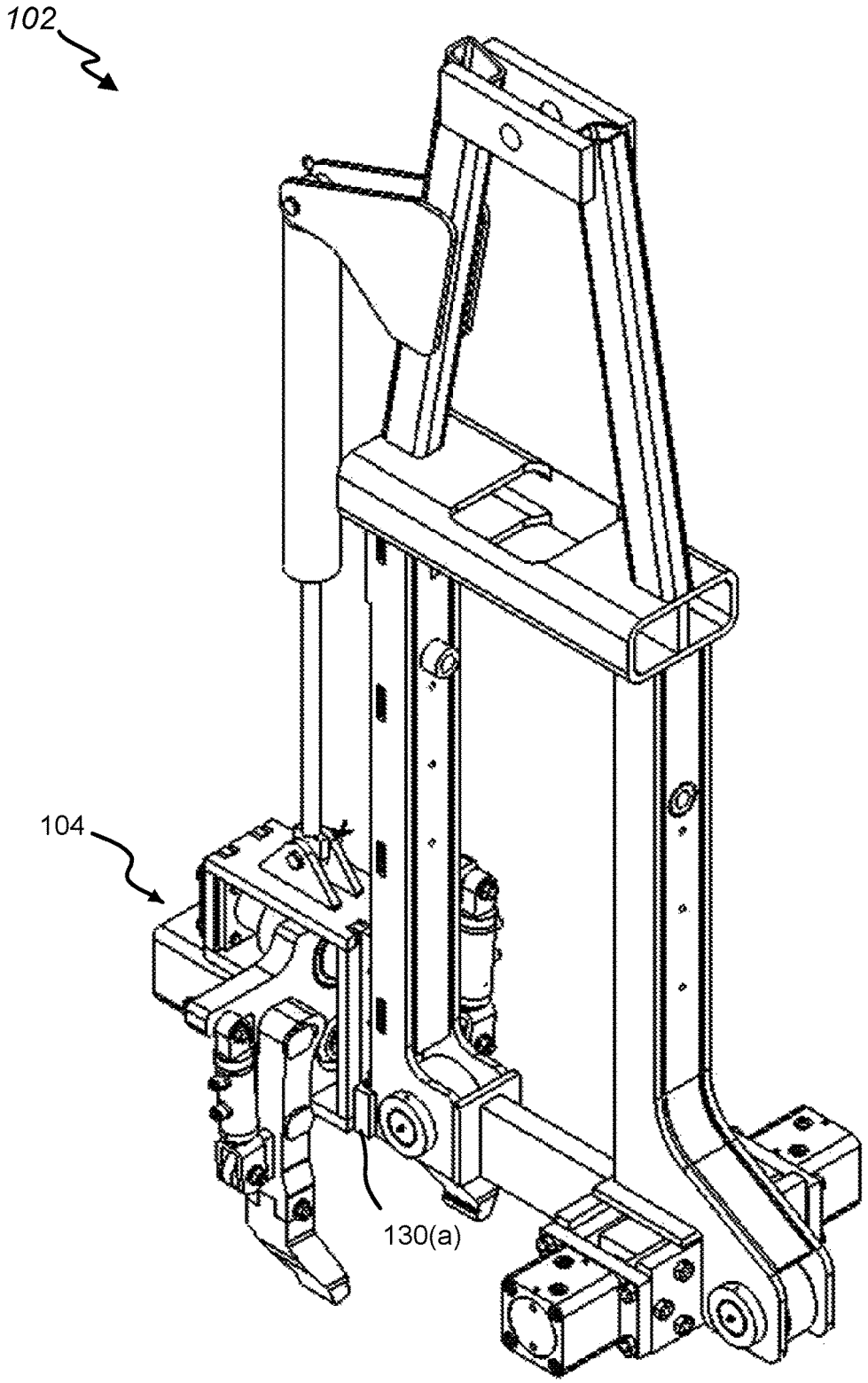
FIG. 2 depicts a perspective view of the anchor adjustment assembly, in accordance with certain embodiments of the present disclosure.

FIG. 2 depicts a perspective view of the anchor adjustment assembly 102, in accordance with certain embodiments of the present disclosure. The anchor adjustment assembly 102 is depicted in FIG. 2 without the spike-pulling workhead 106. In various embodiments, anchor adjustment assembly 102 may be adapted for conjunction with a variety of railway workheads, of which the spike-pulling workhead 106 is one example. The anchor adjustment assembly 102 may include a multifunctional anchor adjuster 104, details of which are disclosed further herein.

Figure 3:
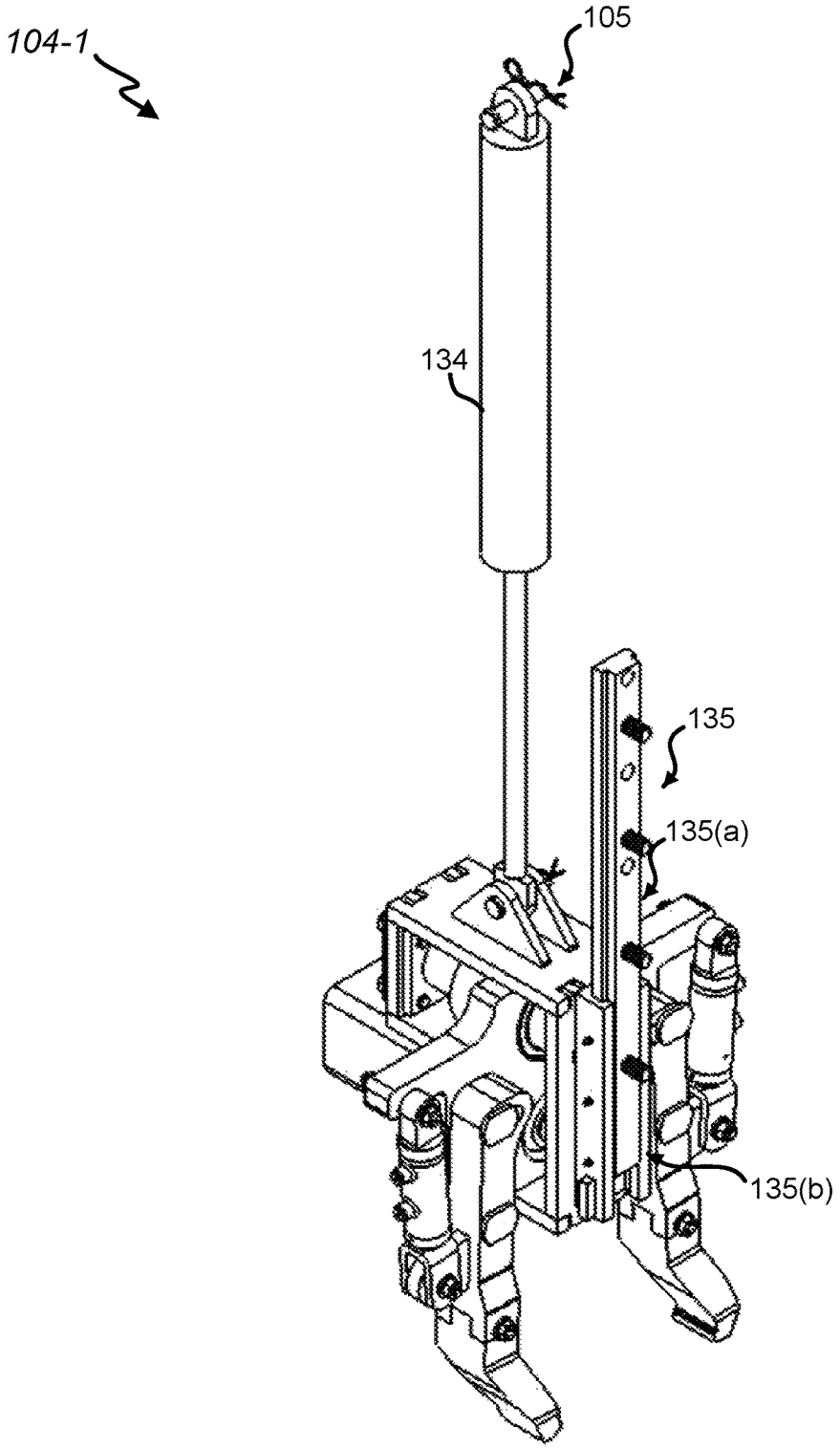
FIG. 3 depicts a perspective view of the multifunctional anchor adjuster, in accordance with certain embodiments of the present disclosure.

FIG. 3 depicts a perspective view of the multifunctional anchor adjuster 104, in accordance with certain embodiments of the present disclosure. Some embodiments of the anchor adjustment assembly 102 may include, for example, a lift cylinder 134 connected to the anchor adjuster 104 with an attachment 105. In some embodiments, the anchor adjustment assembly 102 may include, for example, slide components 135 with one or more attachments. In various embodiments, the anchor adjustment assembly 102 may be attachable to a variety of equipment, frames, workheads, and/or the like, for example, at least in part via the attachment 105 of lift cylinder 134 and the one or more attachments of the slide components 135. Certain examples are disclosed herein.

Figure 4:
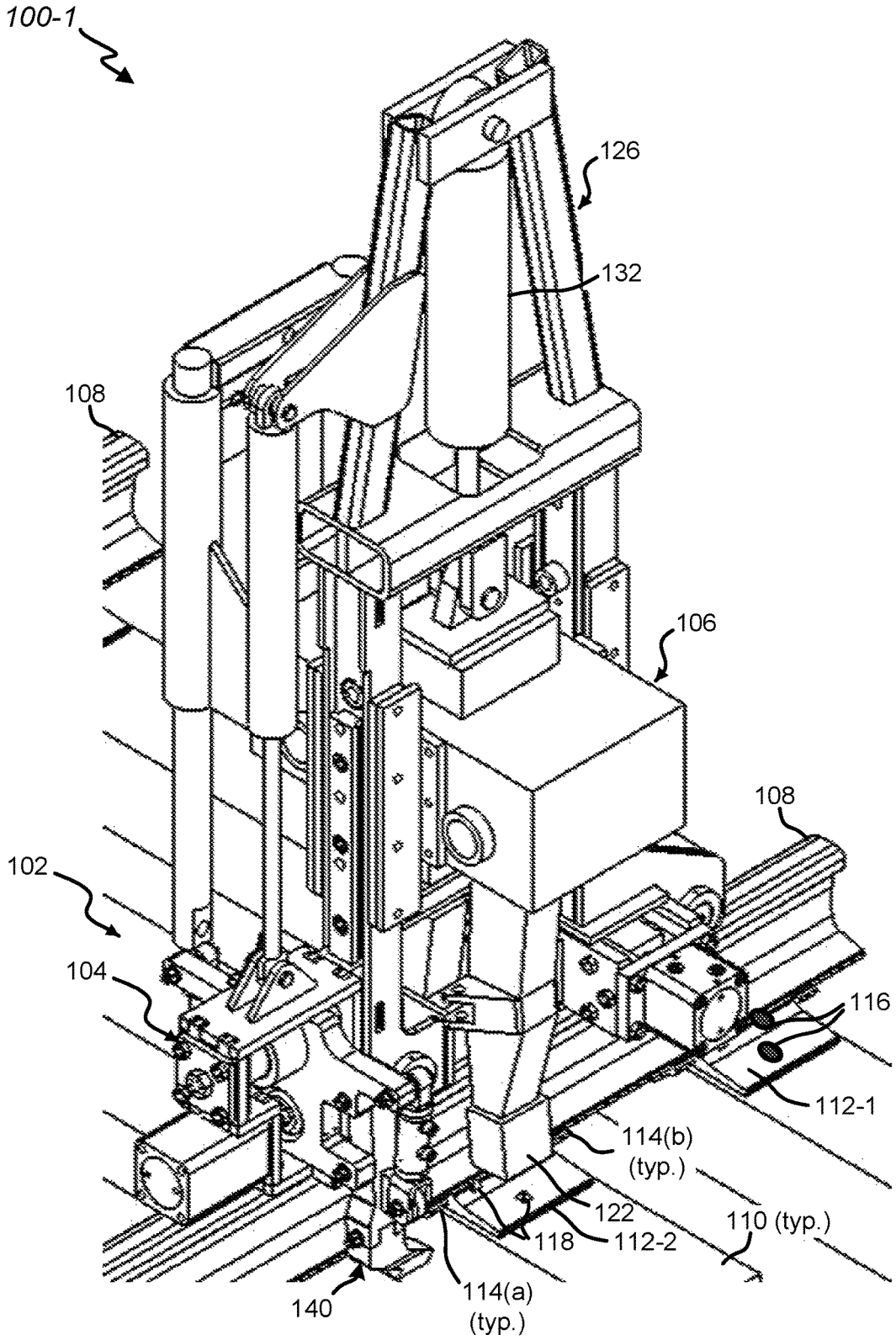
FIG. 4 depicts a perspective view of the multi-functional railway component adjustment system in one example deployed state on a railway, in accordance with certain embodiments of the present disclosure.
Figure 5:
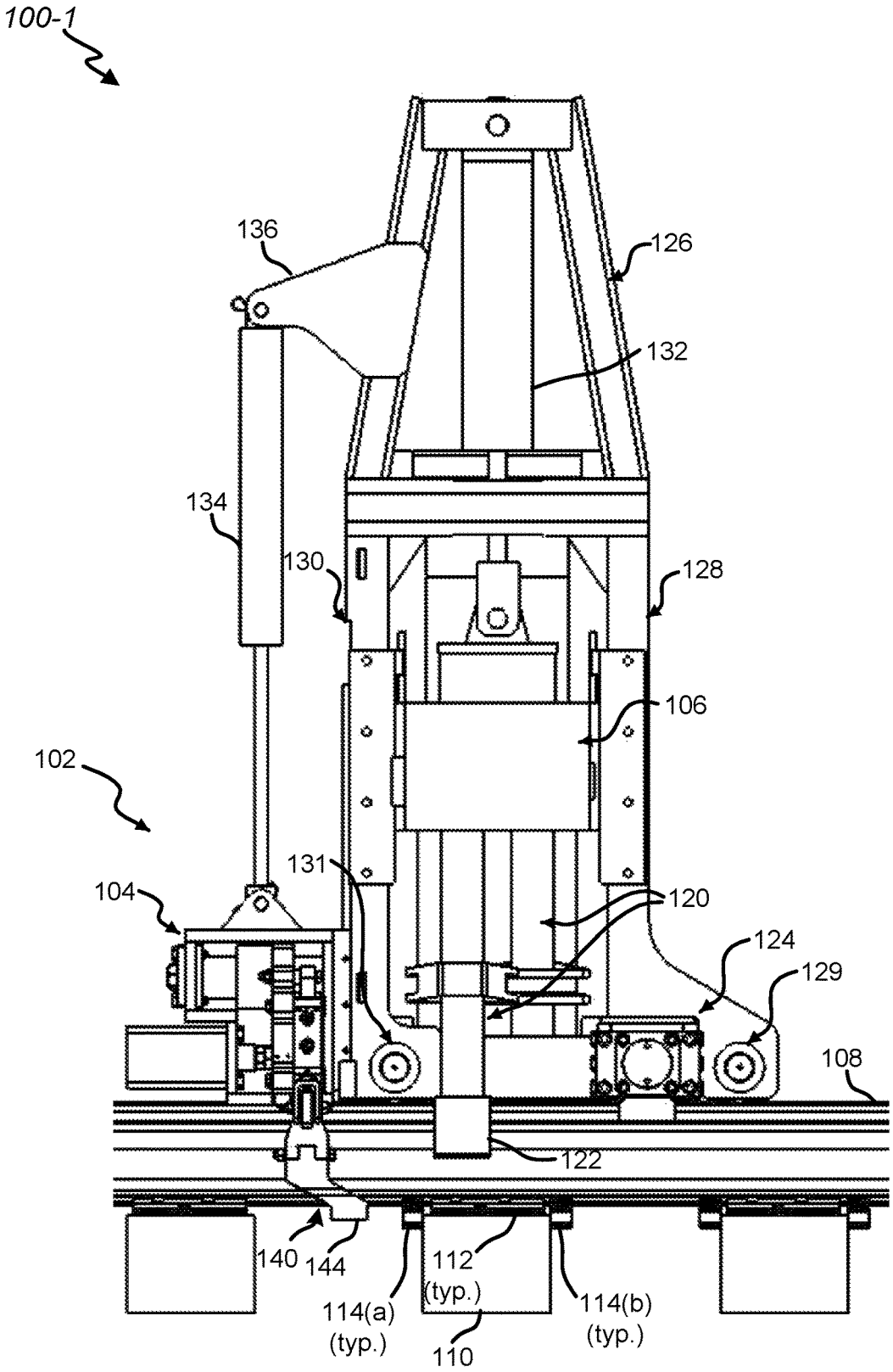
FIG. 5 depicts a side view of the multi-functional railway component adjustment system in one example deployed state on the railway, in accordance with certain embodiments of the present disclosure.
Figure 6:
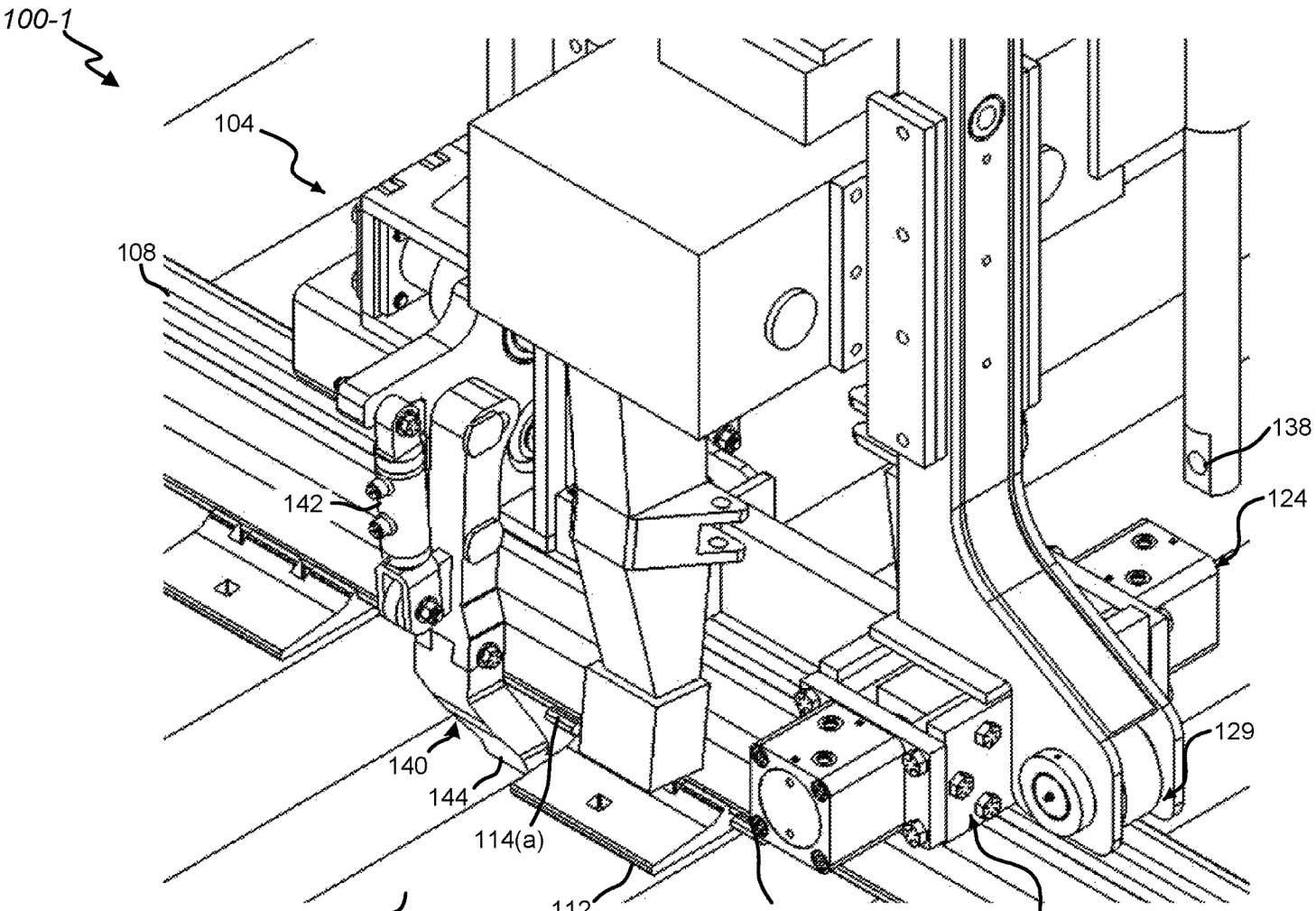
FIG. 6 depicts a close-up partial perspective view of the multi-functional railway component adjustment system in one example deployed state on the railway, in accordance with certain embodiments of the present disclosure.

FIG. 4 depicts the perspective view of a multi-functional railway component adjustment system 100 in one example deployed state on a railway, in accordance with certain embodiments of the present disclosure. FIG. 5 depicts a side view of the multi-functional railway component adjustment system 100 in one deployed state on the railway, in accordance with certain embodiments of the present disclosure. FIG. 6 depicts a close-up partial perspective view of the multi-functional railway component adjustment system 100 in one example deployed state on the railway, in accordance with certain embodiments of the present disclosure. The example deployed states are not limiting; other deployed states may be employed by various embodiments.

The depicted railway, as is typical, comprises a pair of rails 108 supported by a plurality of railway ties 110 and fastened to the railway ties 110 with a combination of railway spikes 116, tie plates 114 fastened to the railway ties 110 with the railway spikes 116 drive through spike holes 118 of the tie plates 114, and railway anchors 114(*a*), 114(*b*) attached to undersides of the rails 108 to anchor the rails to sides the railway ties 110. As used herein, the term "gage side" is used to indicate an association with a space between the pair of rails 108 and/or a side of a rail 108 or other component exposed to, facing, and/or oriented toward the space between the pair of rails 108. The term "field side" is used to indicate an association with a space external to the pair of rails 108 and/or a side of a rail 108 or other component exposed to, facing, and/or oriented toward the space external to the pair of rails 108.

The multi-functional railway component adjustment system 100 (referenced further herein as component adjustment system 100) may be coupled to a motorized railway maintenance vehicle (not shown). The railway maintenance vehicle may include an engine, a chassis, wheels for traversing along one or more of the rails 108, and other suitable components known to a person of ordinary skill in the art. Accordingly, the railway maintenance vehicle may include an operator cab, station, or other area with control elements of a control system that allow for control of the railway maintenance vehicle. The railway maintenance vehicle may be any suitable vehicle adapted for coupling to the component adjustment system 100.

The component adjustment system 100 may include a rigid, metal frame 126, which, in some embodiments, may correspond to an A-frame configuration. Other frame configurations may be included in other embodiments. The spike-pulling workhead 106 may utilize the frame 126 structure as a surrounding structure to house the spike-pulling arms 120 and a lift cylinder 132 arranged to raise and lower the spike-pulling arms 120.

The frame 126 may include a forward leg 128 that is connected to a roller assembly 129 that is disposed in a forward position. The references to forward are with respect to one direction of travel of the component adjustment system 100 along the rail 108, however the component adjustment system 100 is moveable in the reverse direction. The frame 126 may further include a rear leg 130 that is connected to a roller assembly 131 that follows the forward leg 128 along the direction of travel. The anchor adjuster 104 may be mounted on the rear leg 130. The forward position of the roller assembly 129 may accommodate a rail clamp assembly 124 of the anchor adjustment assembly 102 that is integrated into the forward leg 128. The roller assemblies 129, 131 include rollers to contact the rail 108 and facilitate movement of the component adjustment system 100 along the rail 108. Thus, the frame 126, including the forward leg 128 and the rear leg 130 may provide a rigid guide structure for the spike-pulling arms 120 to slide vertically during spike pulling and for housing the rollers which allow the frame 126 to roll along the top of the rail head of the rail 108 during use. The roller assembly 129 and the rail clamp assembly 124 may be disposed in a suitable forward position to advantageously provide a forward point of reaction to resist rotations of the assembly 102 when the anchor adjuster 104 exerts forces on railway components.

The spike-pulling workhead 106 may include a pair of pivotally mounted spike-pulling arm 120 in an opposing arrangement. In a deployed state, the spike-pulling arms 120 may be disposed on opposite sides of the rail 108. Each spike-pulling arm 120 may include a spike pulling head 122 at a lower end, each head 122 adapted to engage spikes 116. In certain embodiments, at least a portion of the spike-pulling workhead 106 may correspond to a spike-pulling machine that is operable to repeatedly perform spike-pulling operations. The spike-pulling operations may include a step of aligning the spike-pulling workhead 106 over a given spike 116, e.g., via actuation of a spotting cylinder (not shown) that may be attached to the spike-pulling workhead 106 and/or the frame 126 and another structure of the railway maintenance vehicle and may be adapted to allow for longitudinal adjustment of the spike-pulling workhead 106 forward and rearward with respect to the rail 108. The spike-pulling operations may further include steps of lowering the spike pulling heads 122 via operation of the lift cylinder 132 to a level of the spike 116, closing in toward the rail 108 to engage a head of the spike 116 with a given spike pulling head 122, raise the spike 116 out of its spike hole 118, releasing the spike 116, and readjusting the spike-pulling arm 120 to allow for a subsequent spike pulling operation directed to another spike 116. In the example of FIG. 4, tie plate 112-1 is depicted with the railway spikes 116 not yet removed, while tie plate 112-2 is depicted with railway spikes having been removed from the spike holes 118 by the spike pulling workhead 106 according to a first function of the component adjustment system 100. Following removal of the railway spikes 116, further functions of the component adjustment system 100 may include adjustment of the one or more railway anchors 114 and/or the tie plates 112 by operation of the anchor adjustment assembly 102, which is adapted to make a number of different adjustments to the railway anchors 114.

In various embodiments, the anchor adjustment assembly 102 may further include, for example, a lift cylinder 134 connected to the anchor adjuster 104 and the frame 126 (e.g., via an ear bracket 136), a forward leg 128, a rear leg 130, and/or a rail clamp assembly 124. The lift cylinder 134 may be arranged to raise and lower the anchor adjuster 104. Accordingly, the anchor adjuster 104 may be raised and lowered through a range of retracted and extended positions to allow for stowing of the anchor adjuster 104, deploying the anchor adjuster 104, and making fine-tuned adjustments of the anchor adjuster 104 to precisely address tie plates 112 and/or anchors 114 as disclosed in various embodiments herein. According to some embodiments, when the lift cylinder 134 is fully retracted, the anchor adjuster 104 may be in stowed position; and, when the lift cylinder 134 is fully extended, the anchor adjuster 104 may be on the top of the rail head in a working position. However, other embodiments are possible.

According to certain embodiments, the anchor adjuster 104 may be lowered to a working position with each set of one or more components associated with each railway tie 110, and may be raised to a stowed position or another position suitable for transition between railway ties 110 to create or increase clearance with respect to railway components. Such embodiments may allow for increased adaptability to a variety of working conditions. However, certain embodiments may allow for the anchor adjuster 104 to remain in a lowered working position as the component adjustments system 100 transitions between railway ties 110 to make component adjustments associated with a plurality of railway ties 110. Such embodiments may allow for increased speed and efficiency in making component adjustments with respect to a large number of railway ties 110. Some of such embodiments may include adjusting the adjustment tools 140 to a vertical state or an outward state to create or increase clearance with respect to railway components to accommodate transitions between railway ties 110 while the anchor adjuster 104 remains in a lowered working position.

As in the example embodiment depicted, the anchor adjuster 104 and the lift cylinder 134 may be disposed to follow the frame 126, and may be arranged to complement the spike-pulling function of the spike-pulling workhead 106 with one or more anchor adjustment functions, without disturbing the spike-pulling function and without obstructing an operator's view of the underlying railway tie 110. In some embodiments, the depicted positioning of the anchor adjuster 104 and the lift cylinder 134 may correspond to an operator side of the frame 126 where an operator may be positioned at an operator station. In some embodiments, the lift cylinder 134 may be attached to the frame 126 by way of the ear bracket 136 that may, in some embodiments, allow for adjustable extension from the framework 126. The lift cylinder 132, the lift cylinder 134, and/or other cylinders in various embodiments described herein may correspond to any one or combination of hydraulic actuators, pneumatic actuators, electric actuators, and/or the like to extend and retract in accordance with certain embodiments, and may be referenced herein as power cylinders or actuators.

In various embodiments, the anchor adjustment assembly 102, working in conjunction with the rail clamp assembly 124, may be adapted to apply approximately 6,000 to 8,500, 10,000, 12,000, or more pounds of force to the railway anchors 114(*a*), 114(*b*). Accordingly, the component adjustment system 100, including the frame 126, its forward leg 128, rear leg 130, and linkages, may be fabricated to possess material strength and overall structural strength to generate and accommodate the forces involved to adjust the railway anchors 114(*a*), 114(*b*) while the rail clamp assembly 124 is engaged to clamp the rail 108. The anchor adjustment assembly 102 may utilize the rail clamp assembly 124 to stabilize the anchor adjustment assembly 102, and, in some embodiments, the spike-pulling workhead 106, during railway anchor adjustment.

Figure 7A:
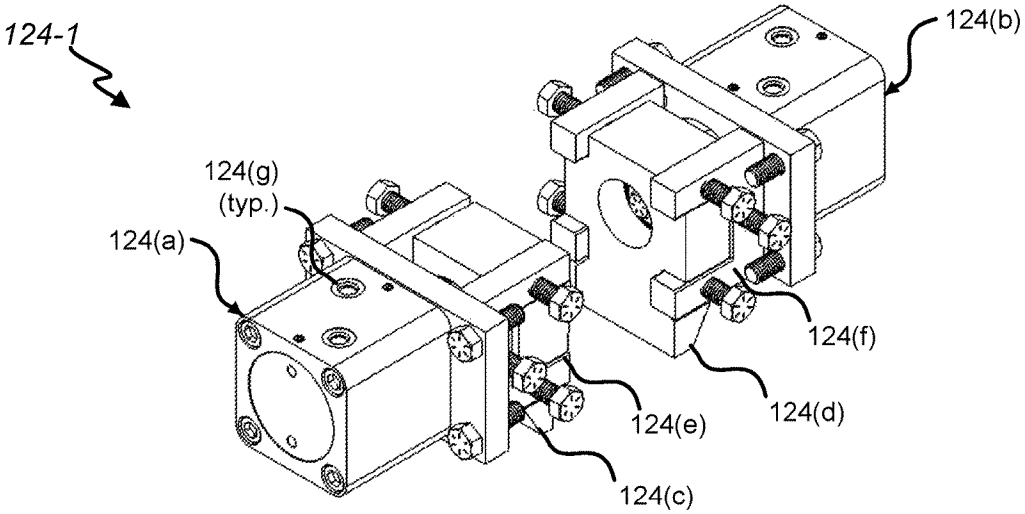
FIG. 7A depicts a perspective view of a portion of the rail clamp assembly, in accordance with certain embodiments of the present disclosure.
Figure 7B:
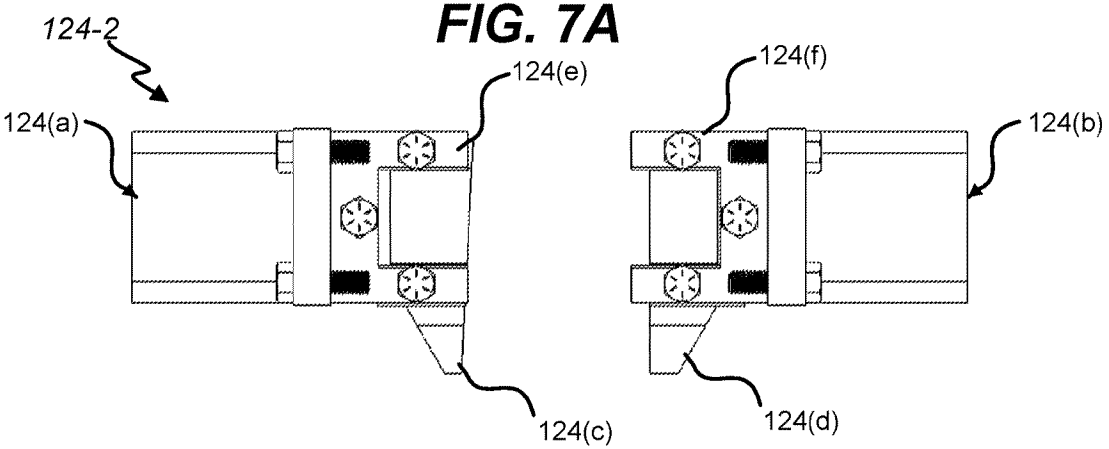
FIG. 7B depicts a side view of the portion of the rail clamp assembly, in accordance with certain embodiments of the present disclosure.

FIG. 7A depicts a perspective view of a portion of the rail clamp assembly 124, in accordance with certain embodiments of the present disclosure. FIG. 7B depicts a side view of the portion of the rail clamp assembly 124, in accordance with certain embodiments of the present disclosure. The rail clamp assembly 124 may include a plurality of fasteners for attachment to a housing 125 (depicted in FIG. 6) of the rail clamp assembly 124 for coupling with the frame 126. The rail clamp assembly 124 may include opposing clamp cylinders 124(*a*), 124(*b*) adapted to extend and retract rail clamp tools 124(*c*), 124(*d*) to respectively grasp and release the rail head of the rail 108. The clamp cylinders 124(*a*), 124(*b*) may each include control ports 125(*g*) for connection to control lines (hydraulic, pneumatic, electrical, etc., in various embodiments) and connection to the control system. Not only the clamp cylinders 124(*a*), 124(*b*), but all of the cylinders disclosed herein may each include control ports 125(*g*) for connection to control lines (hydraulic, pneumatic, electrical, etc., in various embodiments) and connection to the control system. In some embodiments, control valves with solenoids and electrical connections to one or more main processors of the control system may be located at the operators stations or at any suitable place.

Each rail clamp tools 124(*c*), 124(*d*) may be specially formed to work in conjunction with guide blocks 124(*e*), 124(*f*) of the rail clamp assembly 124 which serve to maintain a restrained condition for the rail clamp tools 124(*c*), 124(*d*), while allowing clamping and releasing movements with respect to each other under tightly controlled guidance. Each tool of the rail clamp tools 124(*c*), 124(*d*) may be formed with a particular shape and contour in order to allow for even contact with faces of the rail head. The different shape and angles of the rail clamp tools 124(*c*), 124(*d*) address the cant of the rail 108. The rails of a railway are typically designed and installed to have a slight tilt (e.g., approximately 1.4°) toward the gage side. This is illustrated by FIG. 8.

Figure 8:
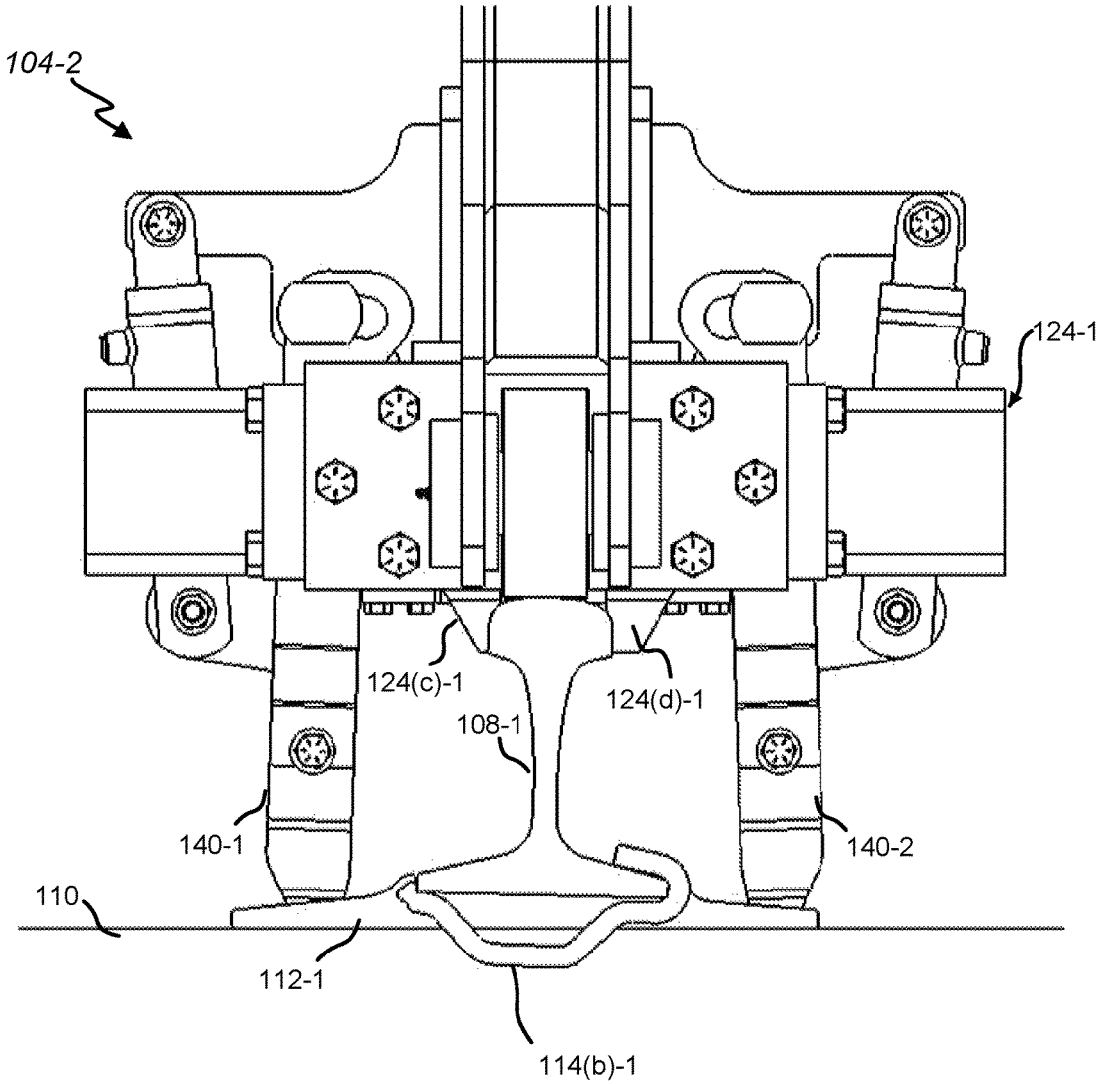
FIG. 8 depicts a view of a portion of the anchor adjuster in a position to address a railway anchor, in according with certain embodiments of the present disclosure.

FIG. 8 depicts a view of a portion of the anchor adjuster 104 in a position to address a railway anchor 112, in according with certain embodiments of the present disclosure. When the rail 108 is positioned within a recess of the tie plate 112, the rail 108 is disposed with a cant biased toward the gage side. To accomplish flush engagement with the rail 108, each tool of the rail clamp tools 124(*c*), 124(*d*) may be different from the other tool, each being formed with a different shape with one or more different angles. Hence, the gage-side rail clamp tool 124(*d*) is different from the field-side rail clamp tool 124(*c*).

Referring again to FIGS. 4-6, in various embodiments, a spotting cylinder (not shown) may be attached to the anchor adjuster 104, the spike-pulling workhead 106, and/or the frame 126 and another structure of the railway maintenance vehicle and may be adapted to allow for longitudinal adjustment of the anchor adjuster 104 forward and rearward with respect to the rail 108. The spotting cylinder may, for example, be attached to the anchor adjustment assembly 102 via attachment point 138 in some embodiments, and may be actuated to various positions along a stroke of approximately 10 inches or any other suitable stroke range. With such a range, the spotting cylinder may be operated to position the anchor adjuster 104 when the anchor adjuster 104 has been placed in an intermediate position of, e.g., approximately five inches from the nearest face of the tie plate 112. Specifically, the spotting cylinder may be retracted to move the anchor adjuster 104 forward so the adjustment tools touch a rear face of the tie plate 112. In other instances, the spotting cylinder may be actuated to move the anchor adjuster 104 forward and/or rearward to facilitate other adjustments disclosed herein.

Figure 9B:
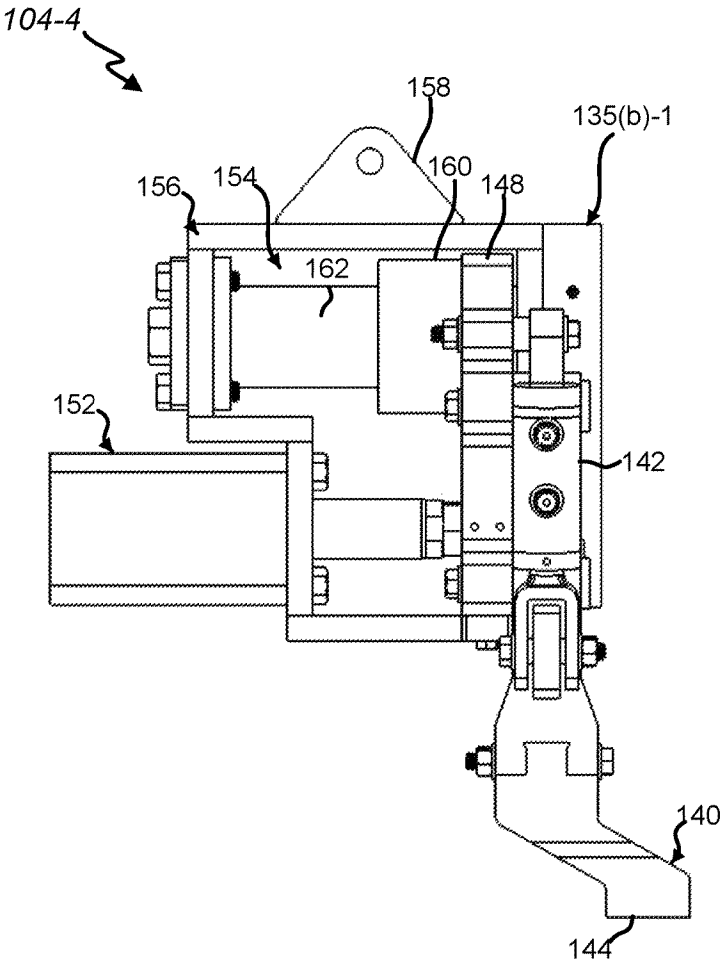
FIG. 9B depicts a side view of the anchor adjuster, in accordance with certain embodiments of the present disclosure.
Figure 9A:
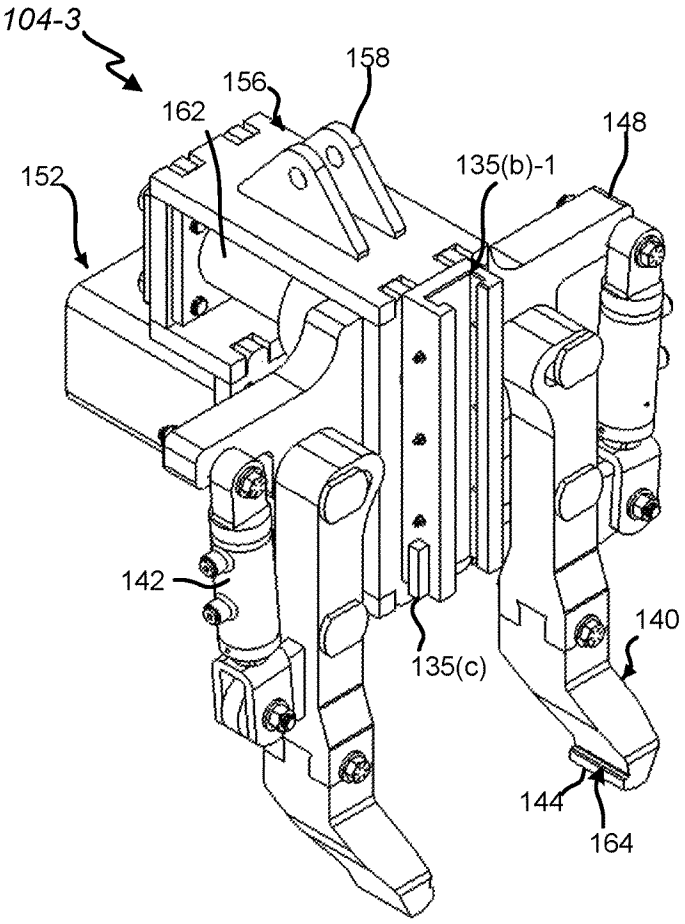
FIG. 9A depicts a perspective view of the anchor adjuster, in accordance with certain embodiments of the present disclosure.
Figure 9C:
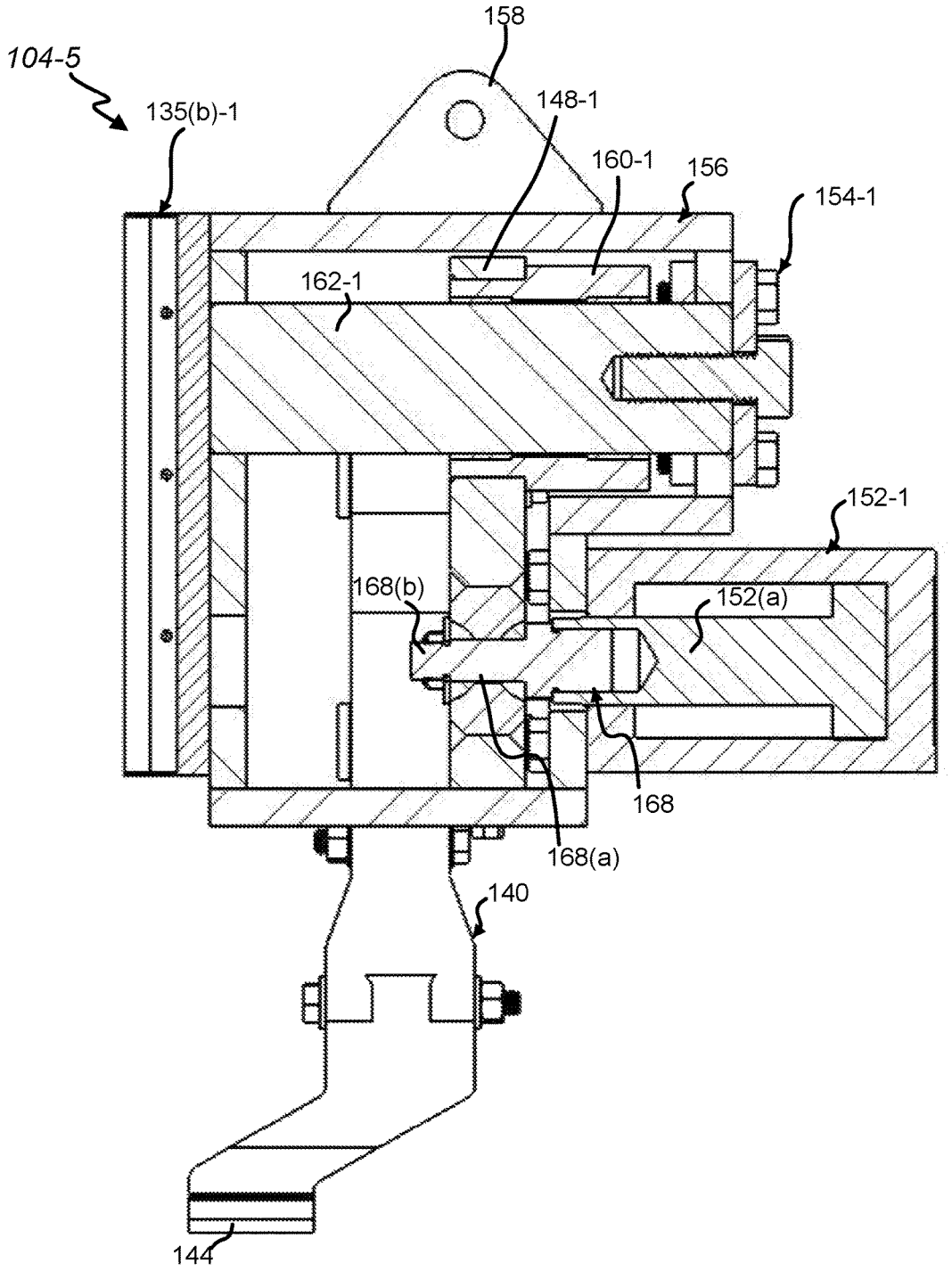
FIG. 9C depicts a partial cross-sectional view of the anchor adjuster, in accordance with certain embodiments of the present disclosure.

FIG. 9A depicts a perspective view of the anchor adjuster 104, in accordance with certain embodiments of the present disclosure. FIG. 9B depicts a side view of the anchor adjuster 104, in accordance with certain embodiments of the present disclosure. FIG. 9C depicts a partial cross-sectional view of the anchor adjuster 104, in accordance with certain embodiments of the present disclosure. The anchor adjuster 104 may include one or more multifunctional railway component adjustment tools 140 ("adjustment tools 140") that extend below other components of the anchor adjuster 104 and are specially adapted to facilitate a number of different railway component adjustments in accordance with various embodiments disclosed herein. The anchor adjuster 104 may include one or more adjuster cylinders 152 connected to a sliding tool bracket 148 of the anchor adjuster 104. The adjuster cylinder 152 may be adapted to extend and retract the sliding tool bracket 148 and the adjustment tools 140. A slide shaft assembly 154 may be connected to a main bracket 156 of the anchor adjuster 104, and may be arranged to provide guidance and support to the sliding tool bracket 148 while allowing travel of a sliding journal 160, coupled with the sliding tool bracket 148, along a beam 162 of the slide shaft assembly 154. As depicted, the anchor adjuster 104 may employ a cantilevered mounted configuration of the sliding tool bracket 148 to survive stresses involved in making adjustments and to reach forward into a working area in an offset manner in order to increase efficiency when working in conjunction with the spike-pulling workhead 106 and/or other workheads.

Figure 9D:
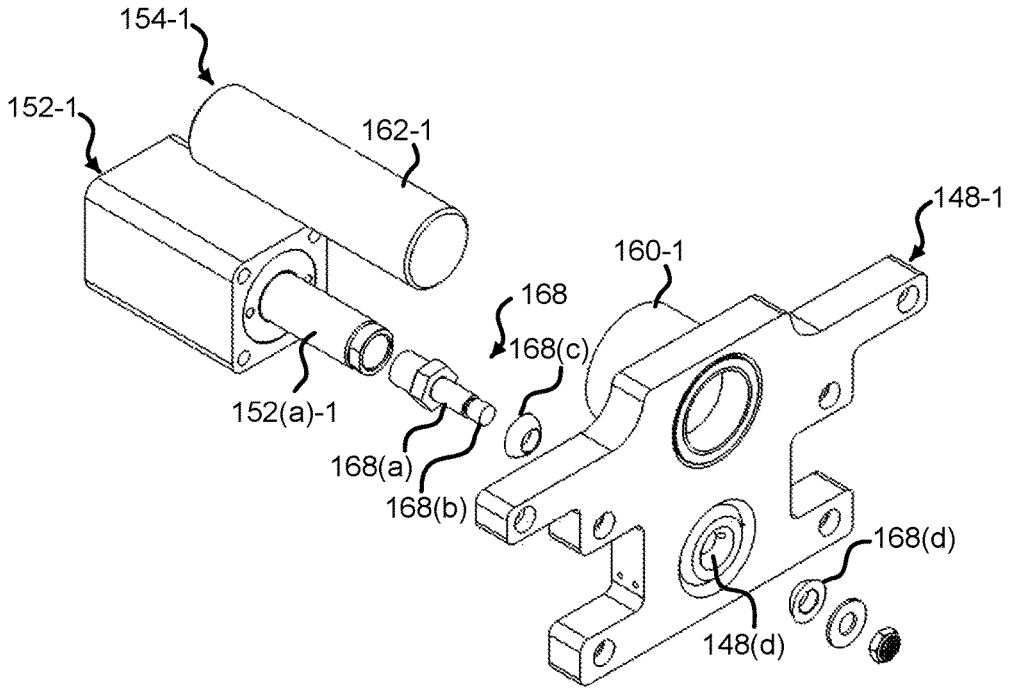
FIGS. 9D and 9E depict exploded views of a portion of the anchor adjuster that includes the adjuster cylinder, the slide shaft, and in accordance with certain embodiments of the present disclosure.
Figure 9E:
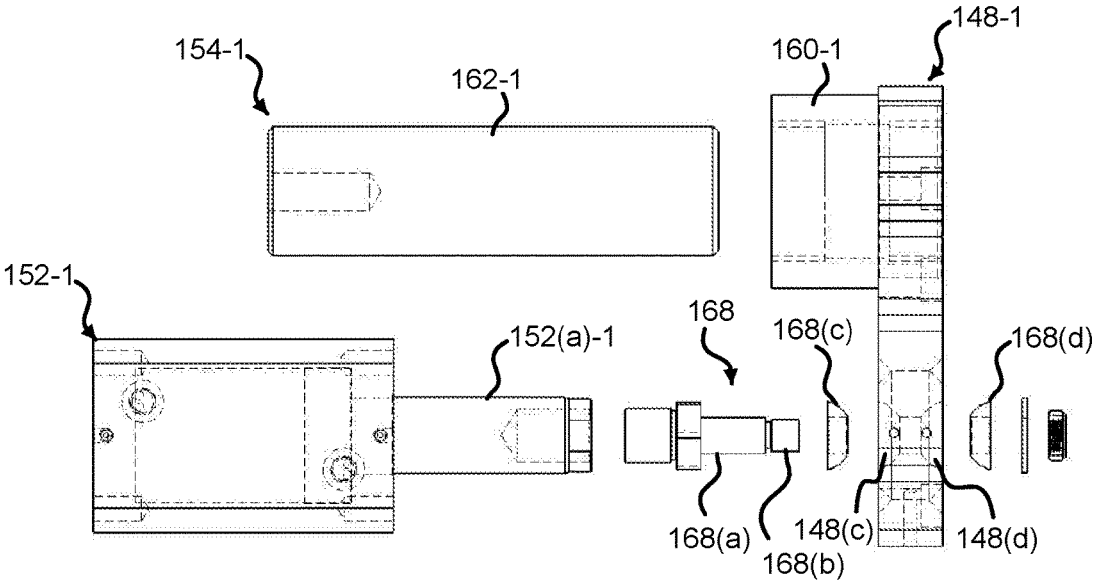

FIGS. 9D and 9E depict exploded views of a portion of the anchor adjuster 104 that includes the adjuster cylinder 152, the slide shaft assembly 154, and in accordance with certain embodiments of the present disclosure. The orientation of the slide shaft assembly 154 above the adjuster cylinder 152 may be key to reducing moments applied about the slide shaft assembly 154. The configuration may allow for a smaller size shaft and other components to allow the compactness as a whole.

An attachment member 158 may be connected to the main bracket 156 and may be formed to provide an attachment point for the lift cylinder 134. The attachment member 158 may be connected to the main bracket 156 and a point corresponding to an average center of gravity for the balance of the anchor adjuster 104, considering the movements of the sliding tool bracket 148 and other components coupled therewith, to allow for optimized movements with the slide components of the anchor adjuster 104 and the rear leg 130, such as the slide components 135 (referenced with respect to FIG. 3). The slide components 135 may facilitate vertical movement of the anchor adjuster 104. The slide components 135 may include a tongue and groove bracket that includes a female tongue and groove bracket 135(*b*) to receive the male component 135(*a*) of the slide components 135. FIGS. 9A, 9B show close-up views of the female tongue and groove bracket 135(*b*).

The female tongue and groove bracket 135(*b*) may include one or more keys 135(*c*) on one or more outside surfaces of the bracket 135(*b*) that may fit into and lock into a set of one or more corresponding grooves and stop 130(*a*) in the lower structure of the anchor adjustment assembly 102. For example, as illustrated in FIG. 2, a corresponding groove and stop 130(*a*) may be included in or attached to the rear leg 130. Another corresponding groove and stop 130(*a*) (not shown) may be included in or attached to the opposite side of the rear leg 130. The locking interface configured with the keys 135(*c*) and the corresponding grooves and stops 130(*a*) may provide a reaction point(s) to facilitate stabilization of the anchor adjuster 104 and other components of the anchor adjustment assembly 102 when the assembly 102 engages and exerts horizontal forces on anchors, tie plates, and/or other components.

This stabilization feature, in conjunction with the other stabilization features of the anchor adjustment assembly 102, synergistically facilitate the ability of the anchor adjustment assembly 102 to generate forces needed to make the component adjustments. Further, the locking interface may be configured to allow a range of vertical movement of the anchor adjuster 104 with respect to the rear leg 130, while still providing the locking and stabilization. For example, the formations of the corresponding grooves 130(*a*) may be elongated to any suitable length to allow the keys 135(*c*) to move within the grooves 130(*a*) while still providing the locking and stabilization. Hence, the elongated groove and key interface limits movement at a range of different relative elevations of the anchor adjuster 104, providing vertical adjustability while still providing reactive limits of horizontal movement.

Figure 9F:
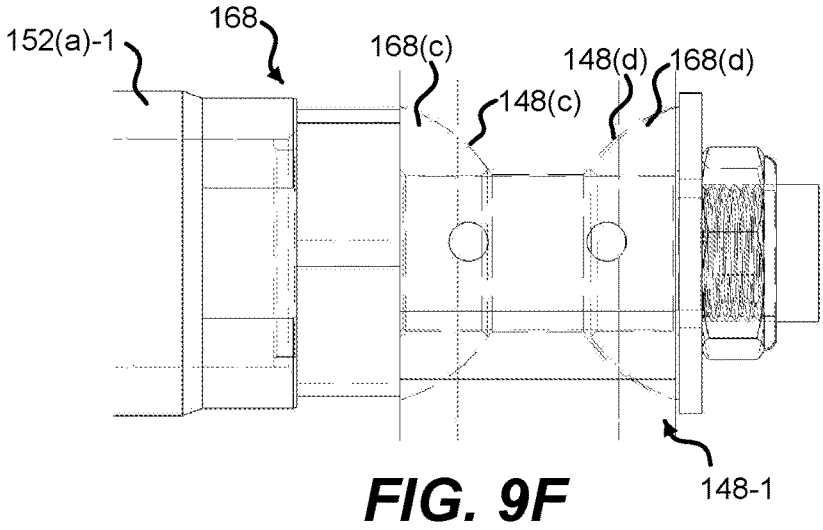
FIGS. 9F and 9G depict close-up views of a portion of the anchor adjuster that include the opposing spherical segment joint assembly interfacing with a portion of the sliding tool bracket, in accordance with certain embodiments of the present disclosure.
Figure 9G:
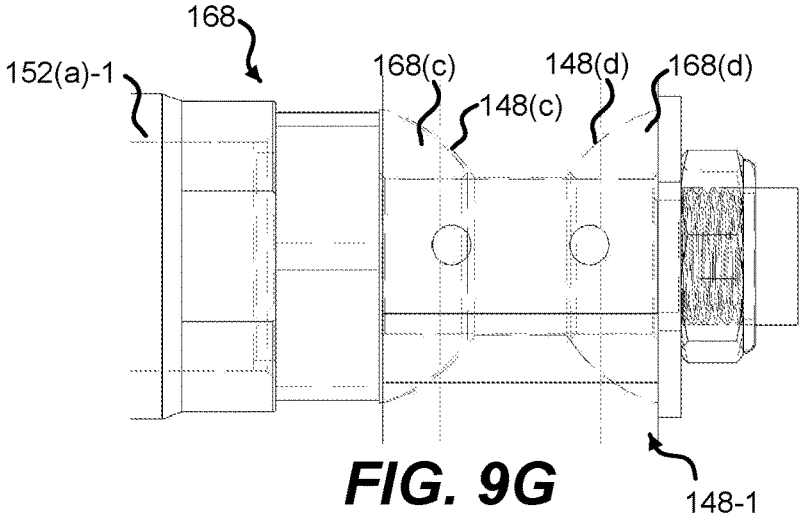
Figure 9H:
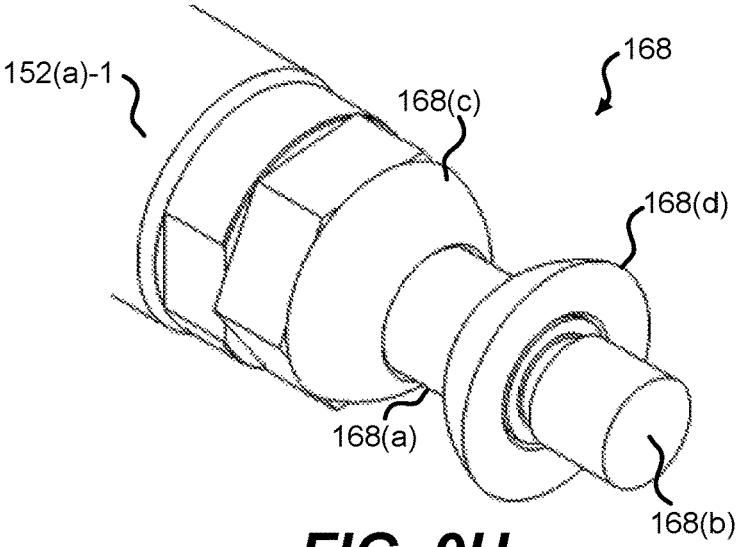
FIG. 9H depicts a perspective view of the opposing spherical segment joint assembly, in accordance with certain embodiments of the present disclosure.

Referring in particular to FIGS. 9C through 9G, the anchor adjuster 104 may include an opposing spherical segment joint assembly 168. The joint assembly 168 may be connected to a rod 152(*a*) of the adjuster cylinder 152, for example, via a threaded connection. The joint assembly 168 may include a smaller diameter portion 168(*a*) that extends through the sliding tool bracket 148 and includes an end threaded portion 168(*b*) for a fastener. FIGS. 9F and 9G depict close-up views of a portion of the anchor adjuster 104 that include the opposing spherical segment joint assembly 168 interfacing with a portion of the sliding tool bracket 148, in accordance with certain embodiments of the present disclosure. FIG. 911 depicts a perspective view of the opposing spherical segment joint assembly 168, in accordance with certain embodiments of the present disclosure. The joint assembly 168 may include back-to-back spherical segment discs 168(*c*), 168(*d*). The sliding tool bracket 148 may include concave pockets 148(*c*), 148(*d*) corresponding to each spherical segment disc 168(*c*), 168(*d*). A gap may exist between a spherical face of one disc of the spherical segment discs 168(*c*) or 168(*d*) and its corresponding concave pocket 148(*c*) or 148(*d*) when the adjuster cylinder 152 is pushing or pulling the sliding tool bracket 148. When the adjuster cylinder 152 is moving the sliding tool bracket 148 in one direction, the spherical segment disc 168(*c*) or 168(*d*) on the side opposite the direction of movement is fully engaged in its concave pocket 148(*c*) or 148(*d*) (to transmit the cylinder force to the sliding tool bracket 148 in order to cause movement in the desired direction), while the other spherical segment disc 168(*c*) or 168(*d*) is allowed to move slightly out of its concave pocket 148(*c*) or 148(*d*). For example, FIG. 9F illustrates the spherical segment disc 168(*d*) slightly out of the concave pocket 148(*d*) to create a gap in response to the adjuster cylinder 152 pushing the sliding tool bracket 148. FIG. 9G illustrates the spherical segment disc 168(*c*) slightly out of the concave pocket 148(*c*) to create a gap in response to the adjuster cylinder 152 pulling the sliding tool bracket 148.

With this configuration, a central axis of the cylinder rod 152(*a*) coincide with central axes of the concave pockets 148(*c*), 148(*d*) and the spherical segment discs 168(*c*), 168(*d*). The selective engagement of either spherical segment disc versus the other allows the sliding tool bracket 148 to have as much freedom of movement as it needs in order to avoid any side loading of the cylinder rod 152(*a*). The freedom of movement may be about the central axis of the cylinder rod 152(*a*) and/or around the spherical face of the disc that is fully engaged in its pocket. As a result, the risk of premature wear to internal cylinder components such as the cylinder seals is minimized.

Figures 10A, 10B, 10C:
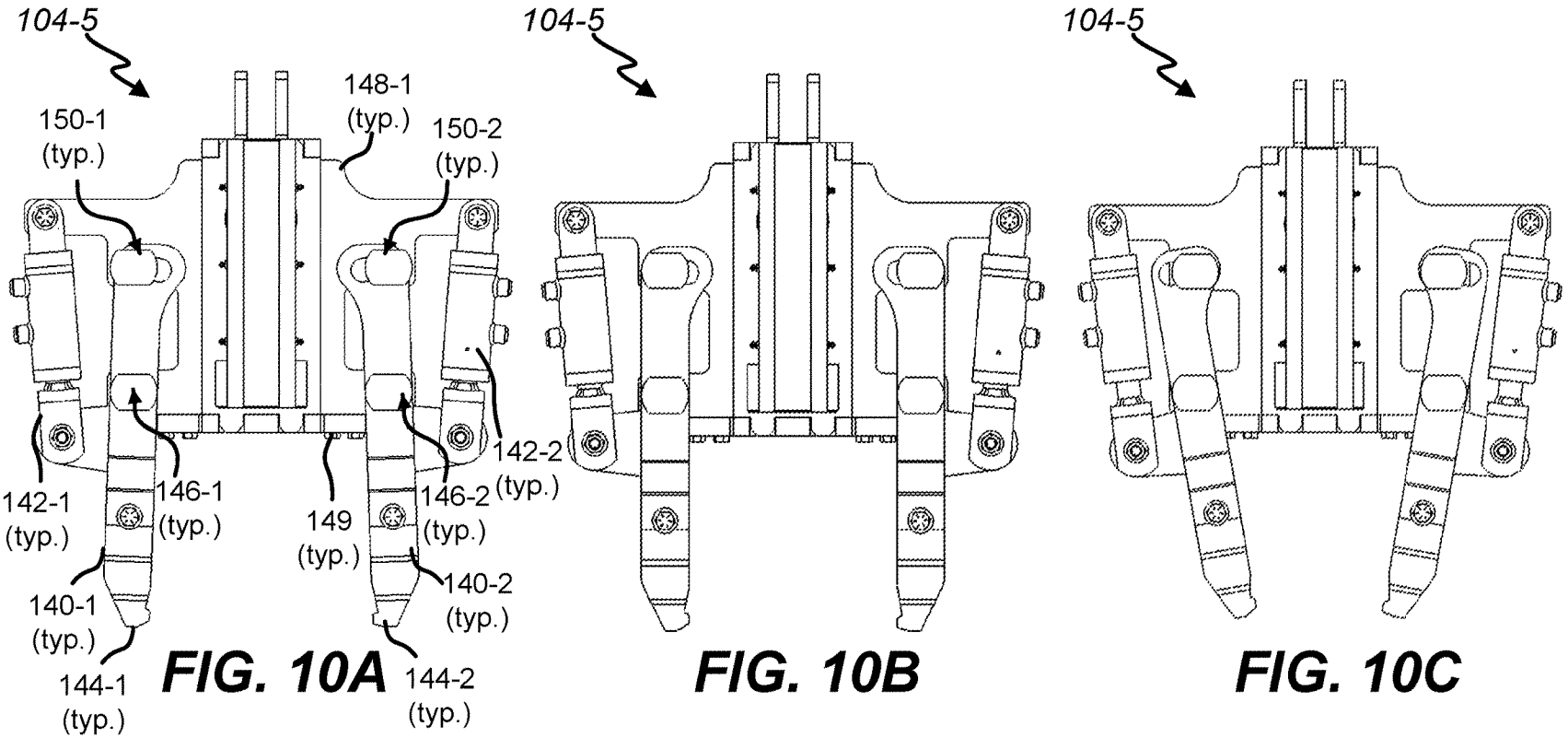
FIGS. 10A, 10B, and 10C depict views of a portion of the anchor adjuster that illustrate different example positions of the adjustment tools, in accordance with certain embodiments of the present disclosure.

FIGS. 10A, 10B, and 10C depict views of a portion of the anchor adjuster 104 that illustrate different example positions of the adjustment tools 140, in accordance with certain embodiments of the present disclosure. The pair of adjustment tools 140 is illustrated in an outward state in FIG. 10A, in a vertical state in FIG. 10B, and in an inward state in FIG. 10C. The anchor adjuster 104 may include one or more tool pivot cylinders 142 arranged to move each adjustment tool 140 about a pivot 146 into a number of different positions. The pivot 146 may correspond to a pivot joint connected to the sliding tool bracket 148. Guide blocks 149 on the bottom of the sliding tool bracket 148 may be adapted to engage a surface of the main bracket 156 in order to prevent any rotation around the beam 162 of the main shaft assembly 154.

In some embodiments, the movement of each adjustment tool 140 may be limited at least in part by a lug and slot assembly 150. The lug and slot assembly 150 may include a slot (which may be formed to include one or more arc shapes) in the adjustment tool 140 and a lug extending from the sliding tool bracket 148 as depicted, or a slot in the sliding tool bracket 148 and a lug extending from the adjustment tool 140 in alternative embodiments.

The range of movement of each adjustment tool 140 includes not only lateral and/or horizontal movement components, but also elevational and/or vertical movement components so that each tool foot 144 may be adjusted along a movement arc with respect to one or more points of articulation, such as the pivot 146, and hold various positions. Accordingly, the anchor adjuster 104 may hold the adjustment tools 140 in a variety of different positions to make anchor adjustments with a variety of different planar changes and force vectors in different elevations, lateral positions, and directions.

However, the illustrated examples are non-limiting. Various embodiments may allow for a greater or lesser range of movement than that depicted in the examples. The various positions to which the anchor adjuster 104 is capable of moving the adjustment tools 140 may facilitate various railway components adjustments disclosed herein, while allowing for greater visibility of the various railway components from an operator's perspective. For example, pivoting the adjustment tools 140 to a vertical state or beyond to an outward state and holding the adjustment tools 140 in a particular position may allow the tool feet 144 to engage and apply force to the tie plate 112, while avoiding the railway anchor 114(*a*). In some embodiments, each adjustment tool 140 may be adjusted and positioned separately from the other adjustment tool 140, e.g., in order to accommodate unique variances in desired working angles. Further, the anchor adjuster 104 provides dynamic adaptability to different sizes of bases of rails 108. Railways not uncommonly have varying sizes of rail bases. One advantage of certain embodiments may be that the embodiments are adaptable to different rail bases such that different equipment and corresponding equipment changes are not necessary. As a corollary, certain embodiments provide for additional advantages of increased speed and efficiency in handling component adjustments associated with a multitude of rail sections of varying sizes.

The adjustment tools 140 may be designed to directly contact/engage surfaces of the railway anchors 114(*a*), 114(*b*) and the tie plate 112 in order to transmit force to and move the railway anchors 114(*a*), 114(*b*) and/or the tie plate 112 along the underside of the rail 108 away from a vertical face of the railway tie 110. A set of the adjustment tools 140 may correspond to a pair of the adjustment tools 140 connected to act as one: one adjustment tool 140 of the pair may be positioned on the gage side of the rail 108 and the other adjustment tool 140 of the pair may be positioned on the field side of the rail 108. With some embodiments, the anchor adjuster 104 may utilize two sets of the adjustment tools 140 to move the railway anchors 114(*a*), 114(*b*) attached to the rail 108: one set positioned to act on the rear anchor 114(*a*) and one set positioned ahead of the first set in order to act on the forward anchor 114(*b*). Additionally, a pair of anchor adjustment assemblies 102 may be employed: one assembly 102 positioned over the left rail 108, and one assembly 102 positioned over the right rail 108.

In some embodiments, the anchor adjuster 104 may allow for tie-removed railway anchor adjustment. Tie-removed railway anchor adjustment may correspond to a method of adjusting railway anchors (e.g., sliding anchors away from each other or completely removing anchors from rails) after removal of the railway tie 110. In this method, the tie plate 112 is not present in its original position between the anchors because it has been displaced by removal of, for example, an old railway tie 110. Movement of the rail anchors in this method may be accomplished by directly engaging and moving one or both of the railway anchors 114(*a*), 114(*b*) with the adjustment tools 140 and increasing the distance between the railway anchors 114(*a*), 114(*b*) by a prescribed distance (e.g., approximately up to one to two inches, or more). Some embodiments may include multiple sets of adjustment tools 140 adapted to move both railway anchors 114(*a*), 114(*b*) simultaneously. Prior to the anchor adjuster 104 moving one or more of the railway anchors 114(*a*), 114(*b*), the rail clamp of the rail clamp assembly 124 may engage and clamp the rail 108 to stabilize the system 100 and facilitate generation of the necessary forces.

Figure 11:
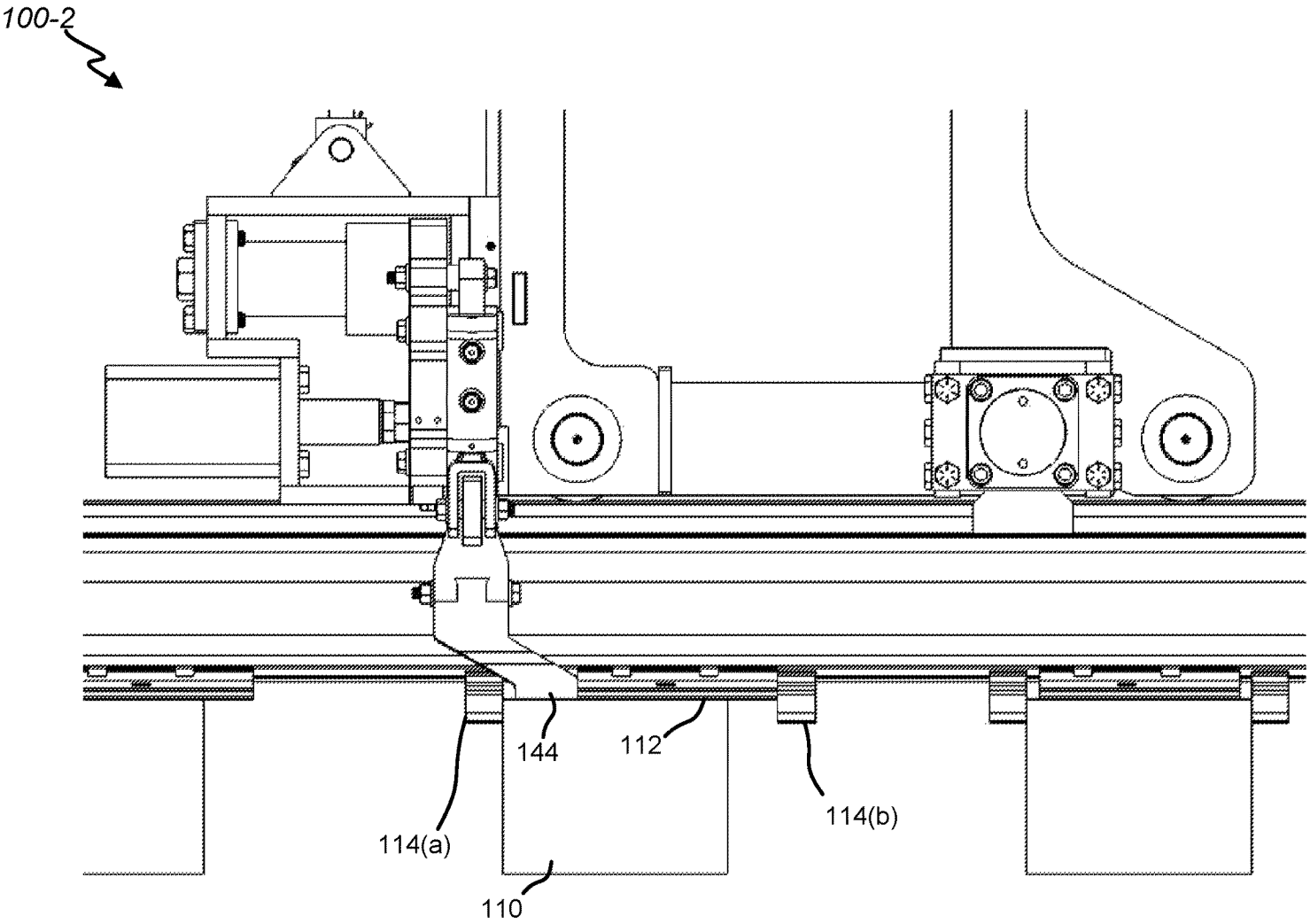
FIG. 11 depicts a side view of the multi-functional railway component adjustment system making one example tie-present railway anchor adjustment, in accordance with certain embodiments of the present disclosure.

In some embodiments, the anchor adjuster 104 may also allow for tie-present railway anchor adjustment. FIG. 11 depicts a side view of the multi-functional railway component adjustment system 100 making one example tie-present railway anchor adjustment, in accordance with certain embodiments of the present disclosure. FIGS. 6 and 8 also illustrate the multi-functional railway component adjustment system 100 making example tie-present railway anchor adjustments. Tie-present railway anchor adjustment may correspond to a method of adjusting rail anchors (e.g., sliding anchors away from tie faces or completely removing anchors from rails) prior to removal of the railway tie 110. Alternatively or additionally, tie-present railway anchor adjustment may correspond to a method of adjusting rail anchors by sliding anchors toward tie faces (e.g., along with installation of a new and/or replacement railway tie 110, or when seating of the anchors 114 against the tie 110 is otherwise needed).

In this method(s), the tie plate 112 is present in its original position between the railway anchors 114(*a*), 114(*b*) because the railway tie 110 has not been disturbed. The example of FIG. 6 depicts the adjustment tool 140 in one example addressing position to engage the tie plate 112 with the tool foot 144. The adjustment tool 140 is shown disposed in a position that allows the tool foot 144 to be disposed on the field side of the railway anchor 114(*a*). From that addressing position with the tool foot 144 engaging the tie plate 112, the anchor adjuster 104 may push the tie plate 112 and the railway anchor 114(*b*) forward. Prior to the anchor adjuster 104 pushing the tie plate 112, the rail clamp of the rail clamp assembly 124 may engage and clamp the rail 108 to stabilize the system 100 and facilitate generation of the necessary forces Movement of the rail anchors in this method may be accomplished using the tie plate 112 by pushing the tie plate 112 till the tie plate 112 makes contact with one of the railway anchors 114(*a*), 114(*b*), then pushing the tie plate 112 a small distance further in order to displace the railway anchors 114(*a*), 114(*b*) away from the tie faces a prescribed distance (e.g., approximately up to one to two inches, or more). Forward and rear railway anchors 114(*a*), 114(*b*) may be moved in succession using the tie plate 112, in that order and/or in reverse order in various embodiments.

In some embodiments, each adjustment tool 140 of the pair of adjustment tools 140 engages the tie plate 112 and/or pushes the tie plate 112 simultaneously or substantially simultaneously. The square face of the tie plate 112 may accordingly contact and substantially evenly apply force to the railway anchor 114(*b*) without skewing the railway anchor 114(*b*) (which skewing may cause the anchor to fly off the rail due to the high tension the anchor is under when in the installed position). Thus, the railway anchor 114(*b*) slides along an underside of the rail 108 away from the railway tie 110.

Figure 12:
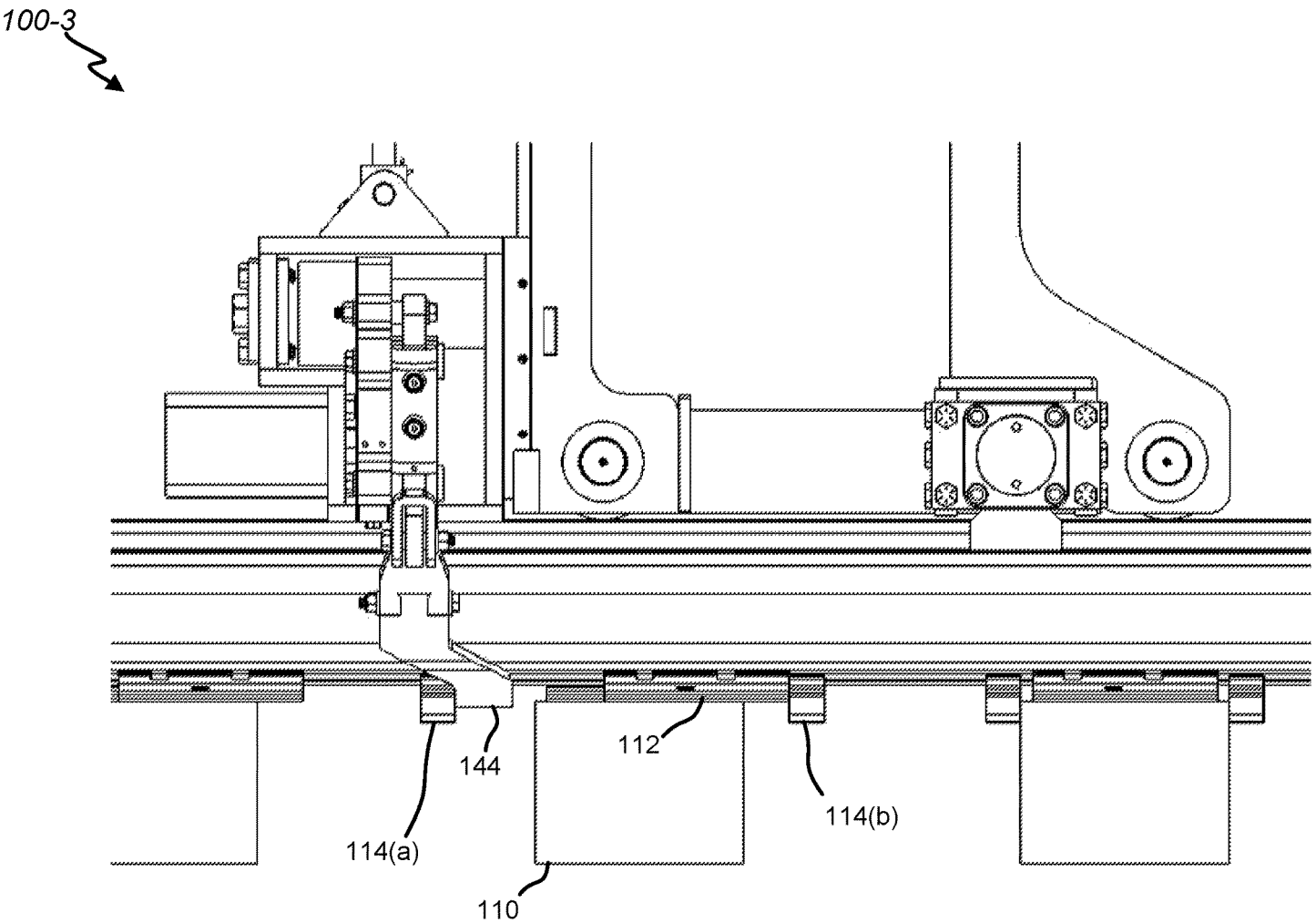
FIG. 12 depicts a side view of the multi-functional railway component adjustment system making another example railway anchor adjustment, in accordance with certain embodiments of the present disclosure.

In some embodiments, the anchor adjuster 104 may also allow for hybrid railway anchor adjustment. FIG. 12 depicts a side view of the multi-functional railway component adjustment system 100 making another example railway anchor adjustment, which may correspond to the hybrid railway anchor adjustment, in accordance with certain embodiments of the present disclosure. Hybrid railway anchor adjustment may correspond to a method of adjusting rail anchors by utilizing the tie plate 112 to move only one of the railway anchors 114(*a*), 114(*b*) (with a pushing or retracting operation) and utilizing the adjustment tools 140 to directly engage and move the other of the railway anchors 114(*a*), 114(*b*). This method may facilitate embodiments where only a single pair adjustment tools 140 (and, in alternative embodiments, only one adjustment tool 140) is utilized to move both railway anchors 114(*a*), 114(*b*). The method of pushing the tie plate 112 and displacing one of the railway anchors 114(*a*), 114(*b*) causes an increased distance between the near face of the one of the railway anchors 114(*a*), 114(*b*) and the other one of the railway anchors 114(*a*), 114(*b*). With the movement of the tie plate 112, a gap between the tie plate 112 and the rear railway anchor 114(*a*) is created or at least widened. The anchor adjuster 104 may then position the tool feet 144 in the gap. For example, the anchor adjuster 104 may pivot the adjustment tools 140 to a vertical state or further to an inward state (in some cases, after or along with backing away from the tie plate 122), thus causing the tool feet 144 to be in close proximity to the base of the rail 108 (e.g., lightly touching or almost touching the rail base). The anchor adjuster 104 may then retract the adjustment tools 140, causing rear faces of the adjustment tools 140 to contact the rear railway anchor 114(*a*) and slide the anchor 114(*a*) away from the rear tie face of the railway tie 110, while the rail clamp of the rail clamp assembly 124 clamps the rail 108. The anchor adjuster 104 may, for example, slide the anchor 114(*a*) up to approximately two inches or more.

Figure 13:
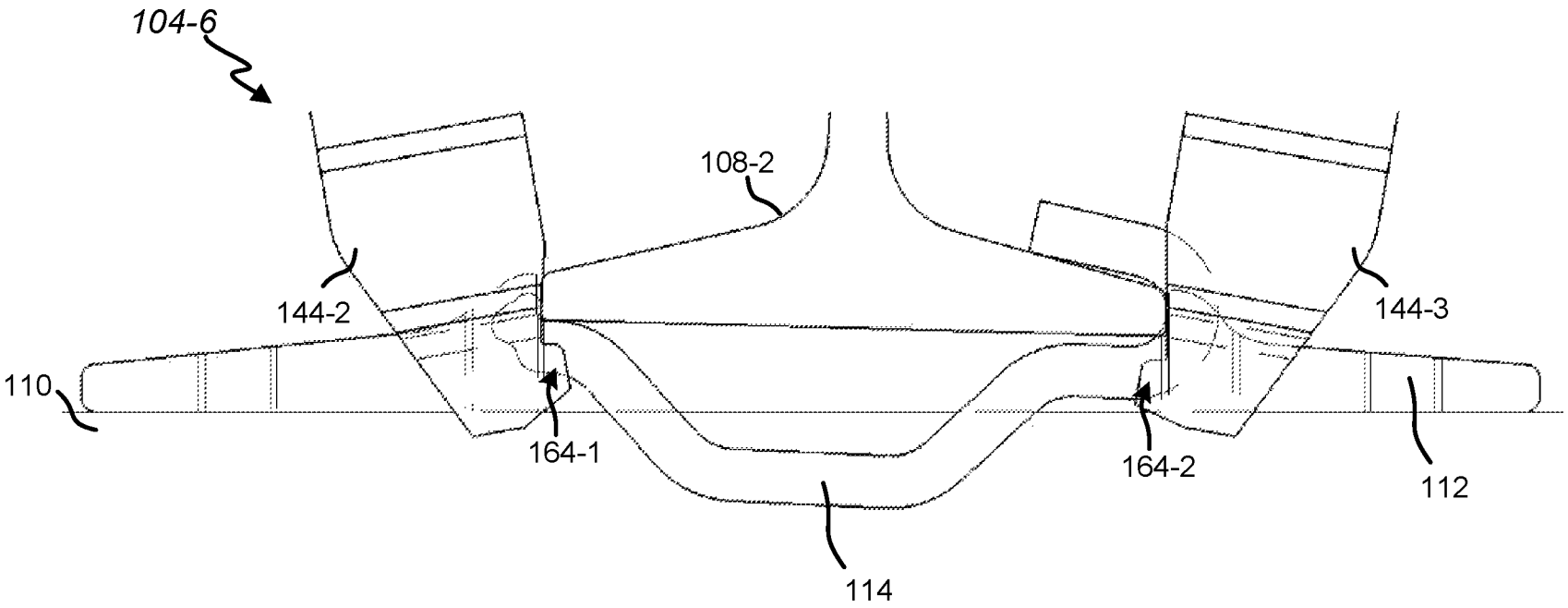
FIG. 13 depicts a partial cross-sectional view of the rail with the tool feet engaging the base plate of the rail, in accordance with certain embodiments of the present disclosure.

FIG. 13 depicts a partial cross-sectional view of the rail 108 with the tool feet 144 engaging the base plate of the rail 108, in accordance with certain embodiments of the present disclosure. As illustrated, the tool feet 144 may be configured for directly and simultaneously engaging the railway anchor 114 and multiple sides of the rail base of the rail 108 to adjust the anchor 114. In various embodiments, the adjustments may include moving the railway anchor 114 for railway tie 110 removal and/or installation, with or without a tie 110 present, and the anchor 114 may correspond to the rear and/or forward anchor.

The angled faces and ledges 164 of the tool feet 144 allow the tool feet 144 to closely engage the base of the rail 108 for the purpose of directly engaging the railway anchors 114 instead of utilizing the tie plate 112 to effect adjustment. Although a gap between the base of the rail 108 and the angled faces and ledges 164 is illustrated, the angled faces and ledges 164 may directly contact the base of the rail 108 such that no gap or a minimal gap is allowed between the underside of the rail 108 and the ledges 164. With the angled faces and ledges 164 directly engaging the base of the rail 108, anti-rotational support (e.g., a counter moment reaction) and stabilization support are provided for the anchor adjustment assembly 102—for example, when the anchor adjuster 104 is moving a railway anchor 114. The ledge surface 164 may be specially adapted to rub an underside of the rail 108 to minimize the risk of any twisting moments that would otherwise cause slipping of the tool foot 144 from the underside of the rail 108. The tool feet 144, including the angled faces and ledges 164, may further provide suitable flat surface area and mass for engaging the end portions of the railway anchors 114. The hook and ledge interface of the tool feet 144 may create an overlap with increased surface area adapted for contacting the railway anchor 114 and to resist a tendency of the tool foot to slip off of the railway anchor 114 during anchor adjustment.

The anchor adjuster 104, including the tool feet 144, may solve a problem due to a gap often existing between each tie plate 112 and railway anchor 114 when a railway tie 110 is present. With the anchor adjuster 104 and the tool feet 144, precise placement of tool portions need not be placed in that small gap in order to make adjustments. One advantage of certain embodiments according to the present disclosure is that the embodiments facilitate railway component adjustments regardless of the size of the gap. Certain embodiments may be designed to create and/or increase a gap, where the adjustment tools 140 are designed to fix into the gap that the tools create and/or increase, in order to accommodate a wide range of sizes and component tolerances.

Additionally, according to some embodiments, the anchor adjuster 104, including the tool feet 144, may be adapted to provide an additional function of completely removing railway anchors 114. Such removal may be desirable for individual railway anchors that may be deteriorated or otherwise need replacing. One or more of the tool feet 144 (e.g., 144-2 in the example depicted) may be formed for engaging a field side of a railway anchor 114 with downward movement on that field side of railway anchor 114. In some instances, the anchor adjuster 104 may be configured to move the railway anchor 114 longitudinally away from a railway tie 110 prior to the anchor removal operation.

Figure 14:
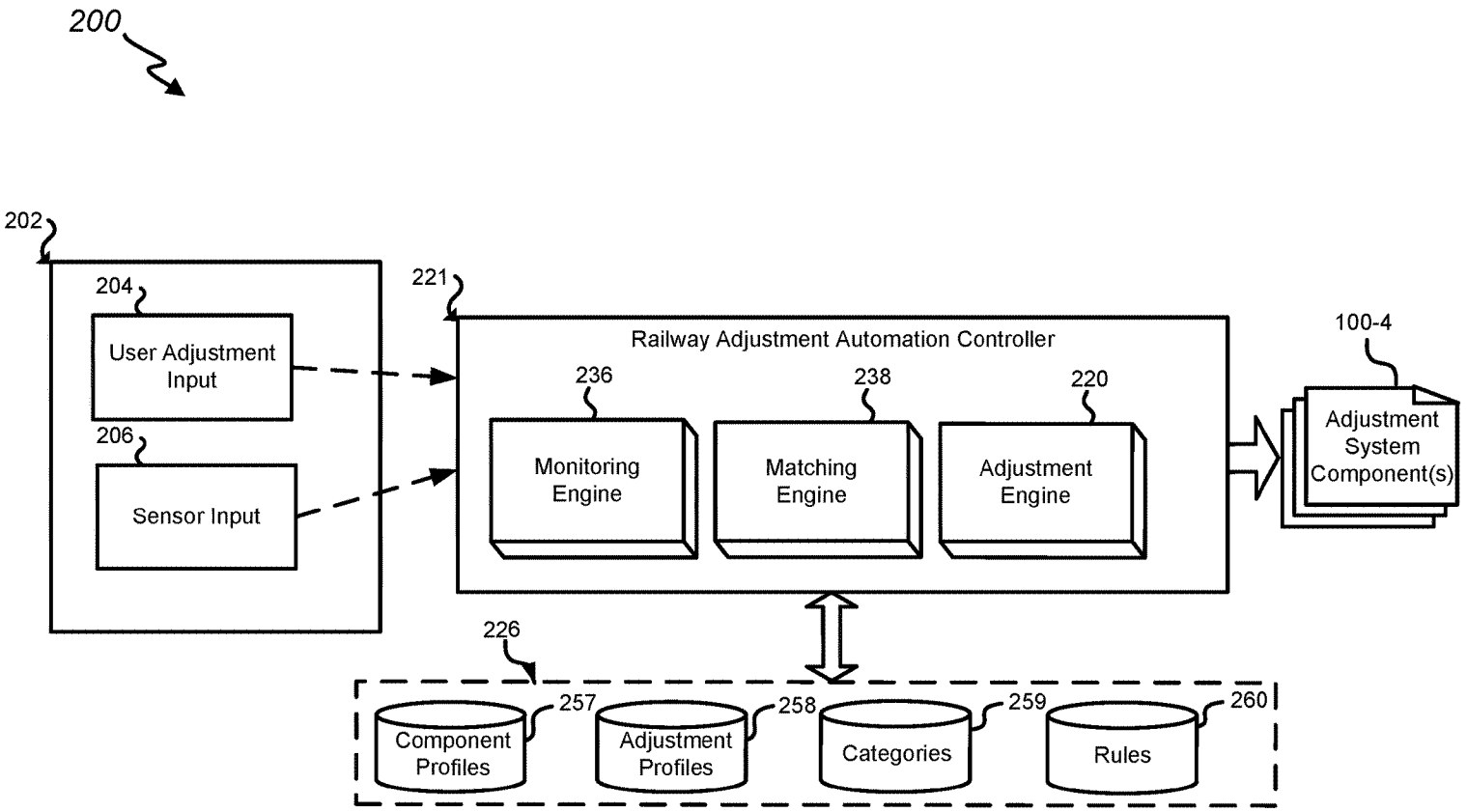
FIG. 14 illustrates a subsystem to facilitate railway component adjustment automation control, in accordance with certain embodiments of the present disclosure.

FIG. 14 illustrates a subsystem 200 to facilitate railway component adjustment automation control, in accordance with certain embodiments of the present disclosure. In some embodiments, the subsystem 200 may be included in or otherwise control aspects of the multi-functional railway component adjustment system 100. While the subsystem 200 is illustrated as being composed of multiple components, it should be understood that the subsystem 200 may be broken into a greater number of components or collapsed into fewer components. Each component may include any one or combination of computerized hardware, software, and/or firmware. In various embodiments, the subsystem 200 includes a railway component adjustment system controller and/or control engine 221, executed by one or more processors and may be implemented with any suitable device, such as a computing device, a standalone system controller device, a system controller device integrated with another device, such as operator station control device, etc.

The railway component adjustment system controller 221 may be communicatively coupled with interface components and communication channels (which may take various forms in various embodiments as disclosed herein) configured to receive adjustment input 202. As depicted, the adjustment input 202 may include user adjustment input 204. The user input 204 may include real-time user control via a user interface—e.g., one or more interfaces provided via the operator station.

In some embodiments, the adjustment input 202 may further include sensor input 206. Some embodiments of the component adjustment system 100 may include a plurality of sensors (e.g., position sensors, measurement sensors, distance sensors, proximity sensors, cameras for optical recognition, image analysis, metrics, and recognition, and/or the like) attached to any suitable element of the component adjustment system 100 and disposed to capture and sensor data that facilitates automatic alignment by detecting various features such as positions, surfaces, edges, contours, relative distances, and/or any other suitable indicia of the elements of the system 100 (e.g., the adjustment tools 140) and/or railway components (e.g., spikes, anchors, tie plates, and/or railway ties).

Signals from the plurality of sensors may be utilized by the control system to perfectly align the working assembly before it begins each separate task. Sensors and control units may be coupled and connected in a serial, parallel, star, hierarchical, and/or the like topologies and may communicate to the control system via one or more serial, bus, or wireless protocols and technologies which may include, for example, WiFi, CAN bus, Bluetooth, I2C bus, ZigBee, Z-Wave and/or the like. For instance, one or more sensors and control units may use a ZigBee® communication protocol while one or more other devices communicate with the television receiver using a Z-Wave® communication protocol. Other forms of wireless communication may be used by sensors, control units, and the control system. For instance, sensors, control units, and the control system may be configured to communicate using a wireless local area network, which may use a communication protocol such as 802.11.

In some embodiments, a separate device may be connected with the control system and/or the operator's station to enable communication with railway component adjustment devices. The separate device may be configured to allow for Zigbee®, Z-Wave®, and/or other forms of wireless communication. In some embodiments, the control system and/or the operator's station may be enabled to communicate with a local wireless network and may use a separate communication device in order to communicate with sensors and control units that use a ZigBee® communication protocol, Z-Wave® communication protocol, and/or some other wireless communication protocols.

The subsystem 200 may process sensor input 206 and analyze the sensor input 206 to provide for railway component adjustment automation control of one or more aspects of the component adjustment system 100. The sensor input 206 may be captured by any or combination of the sensors/detectors disclosed herein to facilitate detection, recognition, and differentiation of one or combination of types of movements, directions of movements, speeds of movements, device use, and/or the like. The sensor input 206 may include location data, such as any information to facilitate detection, recognition, and differentiation of one or combination of locations of one or more components of the component adjustment system 100 and/or railway components in and/or about the component adjustment system 100.

In some embodiments, a monitoring engine 236 may gather and process adjustment input 202 to facilitate creation, development, and/or use of railway adjustment profiles 226, including railway component profiles 257, adjustment action profiles 258, categories 259, and/or rules 260. The data may include any suitable data that may be captured to indicate, infer, and/or determine component and adjustment identification, actions, locations, temporal factors, contexts, and patterns for components and/or adjustments. In some embodiments, the controller 221 may include a matching engine 238 that may be an analysis engine. The matching engine 238 may be configured to perform any one or combination of features directed to matching or otherwise correlating information about components, action data, location data, temporal data, and/or the like. The captured data may be aggregated, consolidated, and transformed into refined profiles. In some embodiments, the monitoring engine 236 and/or the matching engine 238 may facilitate one or more learning/training modes. Some embodiments may perform image analysis of image data captured with cameras on one or more components of the component adjustment system 100 and/or other associated devices to determine one or more image baselines for railway components. Captured railway image data may be correlated to reference images using any suitable railway component traits for correlation.

For example, in some embodiments, the matching engine 238 may determine component characteristics based at least in part on adjustment input 202 received and processed by the monitoring engine 236. The matching engine 238 may define attributes of a railway component sensed based at least in part on the particular characteristics. The matching engine 238 may link railway image data to railway component profiles with image data associated with railway components, to determine identity of railway components. The reference image data may be refined over time as an image baselines for particular railway components are developed with additional data captures. Such reference images may be used by the system to identify inconsistencies/nonconformities with respect to particularized patterns. When such inconsistencies/nonconformities satisfy one or more thresholds, certain adjustment actions may be caused and/or recommended via the user interface.

According to certain embodiments, one or more adjustment sequences may be initiated with a push of a button. The adjustment sequence may include a step of actuating a rail clamp mechanism of the rail clamp assembly 124 to clamp the rail 108 and stabilize the component adjustment system 100. Some embodiments of the adjustment sequence may also include automatic guidance to make positioning determinations of positions of the anchor adjuster 104 and the adjustment tools 140, and to automatically guide the anchor adjuster 104 and the adjustment tools 140 into target positions. Such automatic guidance may include lowering the anchor adjuster 104 from a stowed position to a deployed position, and positioning the adjustment tools 140 in a particular component addressing position to address a railway component, for example, by actuation of the tool pivot cylinders 142, the lift cylinder 132, the lift cylinder 134, adjuster cylinder 152, and/or the spotting cylinder.

The particular component addressing position may depend upon the particular components addressed. Relative component addressing positions with reference to other aspects of the railway and/or system 100 may be differentiated based at least in part on the type of component. For example, in various embodiments, a component addressing position to address the tie plate 112 may be distinct from another component addressing position to address the forward railway anchor 114(*b*), which in turn may be distinct from yet another component addressing position to address the rearward railway anchor 114(*a*). Individualized component addressing schemes, with individualized logic and control specifications, may be defined and stored in the control system memory and/or data store. Other embodiments are possible. In some embodiments, each step or a subset of the steps of the one or more adjustment sequences may be separately initiated by an operator via operator control of input devices.

Figure 15:
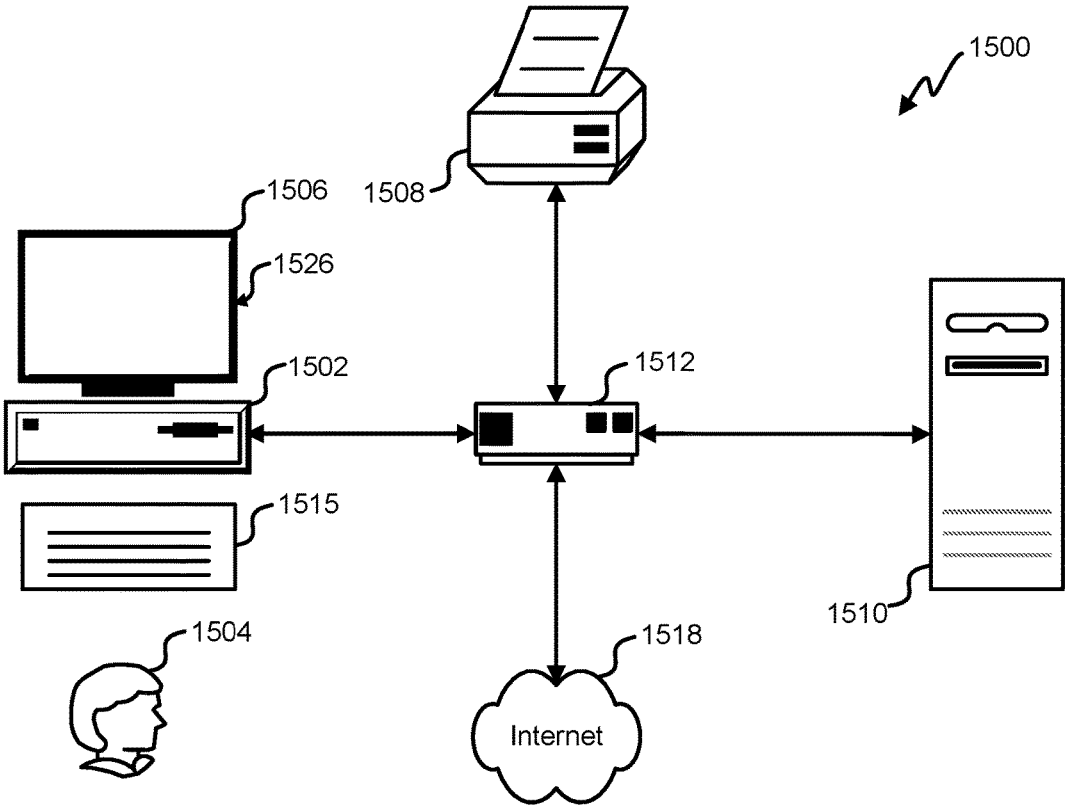
FIG. 15 is a diagram of an exemplary environment with which embodiments may be implemented, in accordance with certain embodiments of the present disclosure.

Referring next to FIG. 15, an exemplary environment with which embodiments may be implemented is shown with a computer system 1500 that can be used by a designer 1504 to design, for example, electronic designs and automation control profiles. The computer system 1500 can include a computer 1502, keyboard 1522, a network router 1512, a printer 1508, and a monitor 1506. The monitor 1506, processor 1502 and keyboard 1522 are part of a computer system 1526, which can be a laptop computer, desktop computer, handheld computer, mainframe computer, etc. The monitor 1506 can be a CRT, flat screen, etc.

A designer 1504 can input commands into the computer 1502 using various input devices, such as a mouse, keyboard 1522, track ball, touch screen, etc. If the computer system 1500 comprises a mainframe, a designer 1504 can access the computer 1502 using, for example, a terminal or terminal interface. Additionally, the computer system 1526 may be connected to a printer 1508 and a server 1510 using a network router 1512, which may connect to the Internet 1518 or a WAN.

The server 1510 may, for example, be used to store additional software programs and data. In some embodiments, software implementing the systems and methods described herein can be stored on a storage medium in the server 1510. Thus, the software can be run from the storage medium in the server 1510. In another embodiment, software implementing the systems and methods described herein can be stored on a storage medium in the computer 1502. Thus, the software can be run from the storage medium in the computer system 1526. Therefore, in this embodiment, the software can be used whether or not computer 1502 is connected to network router 1512. Printer 1508 may be connected directly to computer 1502, in which case, the computer system 1526 can print whether or not it is connected to network router 1512.

Figure 16:
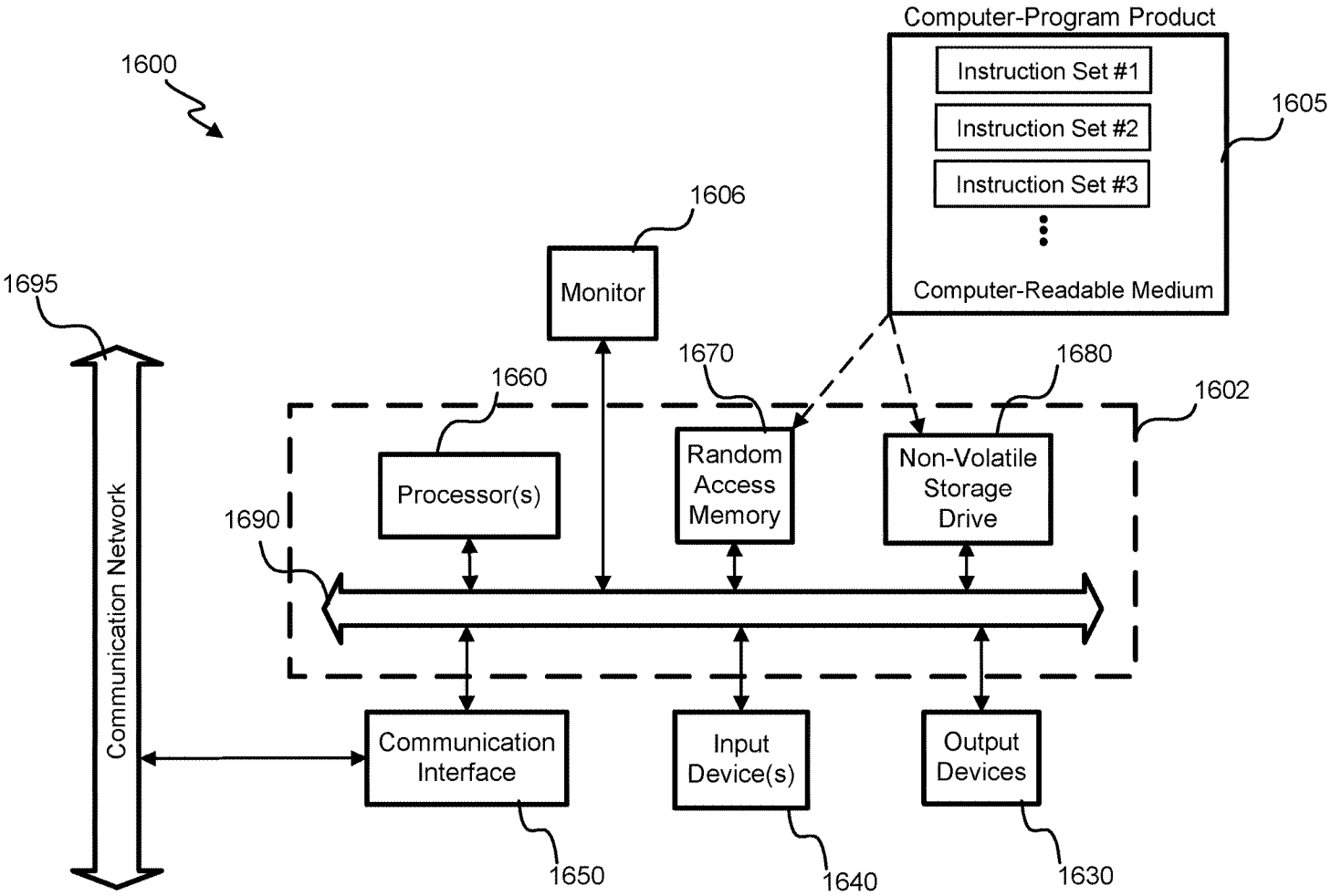
FIG. 16 is a diagram of an embodiment of a special-purpose computer system, in accordance with certain embodiments of the present disclosure.

With reference to FIG. 16, an embodiment of a special-purpose computer system 1600 is shown. The above methods may be implemented by computer-program products that direct a computer system to perform the actions of the above-described methods and components. In some embodiments, the special-purpose computer system 1600 may implement the subsystem 200. In some embodiments, the special-purpose computer system 1600 may be included in a control system that could, for example, be included in an operator station. Each such computer-program product may comprise sets of instructions (codes) embodied on a computer-readable medium that directs the processor of a computer system to perform corresponding actions. The instructions may be configured to run in sequential order, or in parallel (such as under different processing threads), or in a combination thereof. After loading the computer-program products on a general purpose computer system 1626, it is transformed into the special-purpose computer system 1600.

Special-purpose computer system 1600 may include a computer 1602, a monitor 1606 coupled to computer 1602, one or more additional user output devices 1630 (optional) coupled to computer 1602, one or more user input devices 1640 (e.g., joystick, keyboard, mouse, track ball, touch screen) coupled to computer 1602, an optional communications interface 1650 coupled to computer 1602, a computer-program product 1605 stored in a tangible computer-readable memory in computer 1602. Computer-program product 1605 directs system 1600 to perform the above-described methods. Computer 1602 may include one or more processors 1660 that communicate with a number of peripheral devices via a bus subsystem 1690. These peripheral devices may include user output device(s) 1630, user input device(s) 1640, communications interface 1650, and a storage subsystem, such as random access memory (RAM) 1670 and non-volatile storage drive 1680 (e.g., disk drive, optical drive, solid state drive), which are forms of tangible computer-readable memory.

Computer-program product 1605 may be stored in non-volatile storage drive 1680 or another computer-readable medium accessible to computer 1602 and loaded into memory 1670. Each processor 1660 may comprise a microprocessor, such as a microprocessor from Intel® or Advanced Micro Devices, Inc.®, or the like. To support computer-program product 1605, the computer 1602 runs an operating system that handles the communications of product 1605 with the above-noted components, as well as the communications between the above-noted components in support of the computer-program product 1605. Exemplary operating systems include Windows® or the like from Microsoft® Corporation, Solaris® from Oracle®, LINUX, UNIX, and the like.

User input devices 1640 include all possible types of devices and mechanisms to input information to computer system 1602. These may include a keyboard, a keypad, a mouse, a scanner, a digital drawing pad, a touch screen incorporated into the display, audio input devices such as voice recognition systems, microphones, and other types of input devices. In various embodiments, user input devices 1640 are typically embodied as a computer mouse, a trackball, a track pad, a joystick, wireless remote, a drawing tablet, a voice command system. User input devices 1640 typically allow a user to select objects, icons, text and the like that appear on the monitor 1606 via a command such as a click of a button or the like. User output devices 1630 include all possible types of devices and mechanisms to output information from computer 1602. These may include a display (e.g., monitor 1606), printers, non-visual displays such as audio output devices, etc.

Communications interface 1650 provides an interface to other communication networks 1695 and devices and may serve as an interface to receive data from and transmit data to other systems, WANs and/or the Internet 1618. Embodiments of communications interface 1650 typically include an Ethernet card, a modem (telephone, satellite, cable, ISDN), a (asynchronous) digital subscriber line (DSL) unit, a FireWire® interface, a USB® interface, a wireless network adapter, and the like. For example, communications interface 1650 may be coupled to a computer network, to a FireWire® bus, or the like. In other embodiments, communications interface 1650 may be physically integrated on the motherboard of computer 1602, and/or may be a software program, or the like.

RAM 1670 and non-volatile storage drive 1680 are examples of tangible computer-readable media configured to store data such as computer-program product embodiments of the present invention, including executable computer code, human-readable code, or the like. Other types of tangible computer-readable media include floppy disks, removable hard disks, optical storage media such as CD-ROMs, DVDs, bar codes, semiconductor memories such as flash memories, read-only-memories (ROMs), battery-backed volatile memories, networked storage devices, and the like. RAM 1670 and non-volatile storage drive 1680 may be configured to store the basic programming and data constructs that provide the functionality of various embodiments of the present invention, as described above.

Software instruction sets that provide the functionality of the present invention may be stored in RAM 1670 and non-volatile storage drive 1680. These instruction sets or code may be executed by the processor(s) 1660. RAM 1670 and non-volatile storage drive 1680 may also provide a repository to store data and data structures used in accordance with the present invention. RAM 1670 and non-volatile storage drive 1680 may include a number of memories including a main random access memory (RAM) to store of instructions and data during program execution and a read-only memory (ROM) in which fixed instructions are stored. RAM 1670 and non-volatile storage drive 1680 may include a file storage subsystem providing persistent (non-volatile) storage of program and/or data files. RAM 1670 and non-volatile storage drive 1680 may also include removable storage systems, such as removable flash memory.

Bus subsystem 1690 provides a mechanism to allow the various components and subsystems of computer 1602 communicate with each other as intended. Although bus subsystem 1690 is shown schematically as a single bus, alternative embodiments of the bus subsystem may utilize multiple busses or communication paths within the computer 1602.

The above methods may be implemented by computer-program products that direct a computer system to control the actions of the above-described methods and components. Each such computer-program product may comprise sets of instructions (codes) embodied on a computer-readable medium that directs the processor of a computer system to cause corresponding actions. The instructions may be configured to run in sequential order, or in parallel (such as under different processing threads), or in a combination thereof. Special-purpose computer systems disclosed herein include a computer-program product(s) stored in tangible computer-readable memory that directs the systems to perform the above-described methods. The systems include one or more processors that communicate with a number of peripheral devices via a bus subsystem. These peripheral devices may include user output device(s), user input device(s), communications interface(s), and a storage subsystem, such as random access memory (RAM) and non-volatile storage drive (e.g., disk drive, optical drive, solid state drive), which are forms of tangible computer-readable memory.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, hydraulic, pneumatic, and/or electric control connections, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs) or programmable logic controllers (PLCs), field programmable gate arrays (FPGAs), processors, controllers, micro-controllers, microprocessors, other electronic units designed to perform the functions described above, and/or a combination thereof.

Furthermore, embodiments may be implemented by hardware, software, scripting languages, firmware, middleware, microcode, hardware description languages, and/or any combination thereof. When implemented in software, firmware, middleware, scripting language, and/or microcode, the program code or code segments to perform the necessary tasks may be stored in a machine readable medium such as a storage medium. A code segment or machine-executable instruction may represent a procedure, a function, a subprogram, a program, a routine, a subroutine, a module, a software package, a script, a class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, network transmission, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor. As used herein the term "memory" refers to any type of long term, short term, volatile, nonvolatile, or other storage medium and is not to be limited to any particular type of memory or number of memories, or type of media upon which memory is stored.

Moreover, as disclosed herein, the term "storage medium" and variations of the term may represent one or more devices for storing data, including read only memory (ROM), random access memory (RAM), magnetic RAM, core memory, magnetic disk storage mediums, optical storage mediums, flash memory devices and/or other machine readable mediums for storing information. The terms, computer-readable media, processor-readable media, and variations of the term, include, but are not limited to portable or fixed storage devices, optical storage devices, wireless channels and various other mediums capable of storing, containing or carrying instruction(s) and/or data.

Certain elements of the system 100 may be in direct contact with each other and experience relative motion between their contacting (immediately adjacent) faces. In these instances, it may be sufficient to allow steel-on-steel contact and not experience overly destructive wear characteristics over time with normal use, depending on the quality of the base material of each component. Alternatively, in certain instances where relative motion occurs between faces of two or more components, it may be necessary to incorporate additional media between the components in order to absorb any wear from normal use into the replaceable wear component rather than the steel components. For example, a wear pad mounted between the faces of two sliding components to aid in reducing the friction between the two components as they move past one another and to minimize the amount of actual physical wear on the primary components. The wear pad would be the replaceable component meant to be discarded when physical wear reaches a certain limit.

Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning. Furthermore, the use of ordinal number terms, such as "first," "second," etc., to clarify different elements in the claims is not intended to impart a particular position in a series, or any other sequential character or order, to the elements to which the ordinal number terms have been applied.

While the principles of the disclosure have been described above in connection with specific apparatuses and methods, it is to be clearly understood that this description is made only by way of example and not as limitation on the scope of the disclosure.

What is claimed is:

1. A multi-functional railway fastening component adjustment system comprising:

a railway component adjuster comprising:

a tool bracket;

one or more adjustment tools pivotally coupled with the tool bracket;

one or more tool actuators coupled with the one or more adjustment tools and the tool bracket, the one or more tool actuators adapted to cause pivotal movement of the one or more adjustment tools with respect to the tool bracket; and a main bracket comprising one or more attachment components to couple the railway component adjuster to a frame structure;

the railway component adjuster configured to selectively engage each railway fastening component of a plurality of railway fastening components from a plurality of different addressing positions of the one or more adjustment tools at least in part by pivoting to a selected addressing position of the plurality of different addressing positions, wherein:

the plurality of railway fastening components comprises a railway anchor and a railway tie plate;

the railway component adjuster is adapted to hold the one or more adjustment tools in the selected addressing position to make a component adjustment to the railway fastening component with the one or more adjustment tools; and the component adjustment comprises movement of the railway fastening component along a rail of a railway.

2. The multi-functional railway fastening component adjustment system of claim 1, wherein the component adjustment comprises removal of the railway fastening component from the railway.

3. The multi-functional railway fastening component adjustment system of claim 1, wherein the pivoting to the selected addressing position of the plurality of different addressing positions comprises pivoting about one or more pivot points to simultaneously engage a base of the rail and the railway fastening component with one or more tool feet of the one or more adjustment tools.

4. The multi-functional railway fastening component adjustment system of claim 1, wherein the railway component adjuster is configured to selectively engage each railway fastening component of the plurality of railway fastening components from the plurality of different addressing positions of the one or more adjustment tools based at least in part on a first set of one or more methods when a railway tie associated with the railway fastening component is present and a second set of one or more methods in an absence of the railway tie.

5. The multi-functional railway fastening component adjustment system of claim 1, wherein the one or more adjustment tools comprise a pair of adjustment tools in an opposing arrangement to engage the railway fastening component from a gage side of the rail and from a field side of the rail.

6. The multi-functional railway fastening component adjustment system of claim 5, wherein:

the pair of adjustment tools comprises a field-side tool, where the field-side tool comprises a first tool foot, the first tool foot comprising a first ledge and first set of angled faces; and the pair of adjustment tools comprises a gage-side tool, where the field-side tool comprises a second tool foot, the second tool foot comprising a second ledge and second set of angled faces.

7. The multi-functional railway fastening component adjustment system of claim 6, wherein:

the first ledge and first set of angled faces of the first tool foot is formed differently with respect to the second ledge and second set of angled faces of the second tool foot based at least in part on a tilt of the rail toward the gage side of the rail.

8. The multi-functional railway fastening component adjustment system of claim 1, further comprising:

the frame structure coupled to the railway component adjuster at least in part via a power cylinder and a slide component assembly, wherein the frame structure comprises one or more roller assemblies for rolling engagement with the rail; and a rail clamp assembly coupled to a forward leg of the frame structure and adapted to clamp the rail to facilitate the component adjustment.

9. The multi-functional railway fastening component adjustment system of claim 8, wherein the rail clamp assembly comprising an opposing pair of clamp tools adapted to evenly engage surfaces of a head portion of the rail, where a first clamp tool of the opposing pair of clamp tools comprises a first contour and a second clamp tool of the opposing pair of clamp tools comprises a second contour that is different from the first contour, the first contour and the second contour based at least in part on a tilt of the rail toward a gage side of the rail.

10. The multi-functional railway fastening component adjustment system of claim 8, wherein the frame structure is adapted to house a railway workhead, the railway workhead to perform one or more railway component functions that are different from a set of functions performed by the railway component adjuster.

11. The multi-functional railway fastening component adjustment system of claim 1, wherein:

the railway component adjuster comprises a spherical segment joint assembly interfacing with a portion of the tool bracket and coupling the tool bracket to a power cylinder, the spherical segment joint assembly comprising a pair of spherical segment discs in a back-to-back arrangement;

the tool bracket comprises concave pockets corresponding to each spherical segment disc of the pair of spherical segment discs; and an arrangement of the spherical segment joint assembly and the concave pockets allows a first spherical segment disc of the pair of spherical segment discs to move away from a first pocket of the concave pockets responsive to the power cylinder of the railway component adjuster moving the tool bracket in a first direction, and a second spherical segment disc of the pair of spherical segment discs to move away from a second pocket of the concave pockets responsive to the power cylinder moving the tool bracket in a second direction.

* * * * *